US009598746B2

(12) United States Patent
Anelli et al.

(10) Patent No.: US 9,598,746 B2
(45) **Date of Patent: *Mar. 21, 2017**

(54) HIGH STRENGTH STEEL PIPES WITH EXCELLENT TOUGHNESS AT LOW TEMPERATURE AND SULFIDE STRESS CORROSION CRACKING RESISTANCE

(75) Inventors: Ettore Anelli, Bergamo (IT); Mariano Armengol, Bergamo (IT); Paolo Novelli, Bergamo (IT); Federico Tintori, Bergamo (IT)

(73) Assignee: DALMINE S.P.A., Bergamo (IT)

( * ) Notice: Subject to any disclaimer, the term of this patent is extended or adjusted under 35 U.S.C. 154(b) by 498 days.

This patent is subject to a terminal disclaimer.

(21) Appl. No.: 13/367,332

(22) Filed: Feb. 6, 2012

(65) Prior Publication Data

US 2012/0199255 A1 Aug. 9, 2012

(30) Foreign Application Priority Data

Feb. 7, 2011 (IT) ..... MI2011A0180

(51) Int. Cl.
*C21D 10/00* (2006.01)
*C21D 8/10* (2006.01)
(Continued)

(52) U.S. Cl.
CPC ..... *C21D 8/10* (2013.01); *C21D 1/18* (2013.01); *C21D 6/002* (2013.01); *C21D 9/08* (2013.01);
(Continued)

(58) Field of Classification Search
CPC . C21D 1/18; C21D 8/10; C21D 6/002; C21D 2211/002
(Continued)

(56) References Cited

U.S. PATENT DOCUMENTS 3,316,395 A 4/1967 Lavin
3,413,166 A 11/1968 Zackay et al.
(Continued)

FOREIGN PATENT DOCUMENTS

AR 0050159 A1 10/2006
CN 1401809 3/2003
(Continued)

OTHER PUBLICATIONS

NPL: Machine translation of JP2000178645A, Jun. 2000.*
(Continued)

*Primary Examiner* — Jie Yang
(74) *Attorney, Agent, or Firm* — Knobbe Martens Olson and Bear LLP

(57) ABSTRACT

Low-alloy steels and methods of manufacturing pipes having a wall thickness greater than or equal to about 8 mm and less than or equal to about 35 mm therefrom are provided. In one embodiment, a steel composition is processed that yields an average prior austenite grain size greater than about 15 or 20 μm and smaller than about 100 μm. A quenching sequence has been determined that yields a microstructure of greater than or equal to about 60% martensite by volume, and less than or equal to about 40% by volume lower bainite, without substantial formation of ferrite, upper bainite, or granular bainite. The yield strength of the quenched and tempered pipes may be greater than about 70 ksi, 80 ksi, or 90 ksi. The quenched and tempered pipes are suitable for 70 ksi, 80 ksi, and 90 ksi grades and resistant to sulfide stress corrosion cracking.

13 Claims, 7 Drawing Sheets

(51) Int. Cl.

| | |
|---|---|
| ***C21D 1/18*** | (2006.01) |
| ***C21D 6/00*** | (2006.01) |
| ***C21D 9/08*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/22*** | (2006.01) |
| ***C22C 38/24*** | (2006.01) |
| ***C22C 38/00*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |
| ***C22C 38/60*** | (2006.01) |

(52) U.S. Cl.

CPC ..... *C21D 9/085* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/22* (2013.01); *C22C 38/24* (2013.01); *C22C 38/42* (2013.01); *C22C 38/44* (2013.01); *C22C 38/46* (2013.01); *C22C 38/50* (2013.01); *C22C 38/60* (2013.01); *C21D 8/105* (2013.01); *C21D 2211/002* (2013.01); *C21D 2211/008* (2013.01)

(58) Field of Classification Search

USPC ..... 148/593, 335

See application file for complete search history.

(56) References Cited

U.S. PATENT DOCUMENTS

| | | | | |
|---|---|---|---|---|
| 3,655,465 | A | 4/1972 | Snape et al. | |
| 3,810,793 | A | 5/1974 | Heller | |
| 3,915,697 | A | 10/1975 | Giuliani et al. | |
| 4,163,290 | A | 7/1979 | Sutherlin et al. | |
| 4,231,555 | A | 11/1980 | Saito | |
| 4,305,059 | A | 12/1981 | Benton | |
| 4,336,081 | A | 6/1982 | Hijikata et al. | |
| 4,354,882 | A | 10/1982 | Greer | |
| 4,376,528 | A | 3/1983 | Ohshimatani et al. | |
| 4,379,482 | A | 4/1983 | Suzuki et al. | |
| 4,407,681 | A | 10/1983 | Ina et al. | |
| 4,491,725 | A | 1/1985 | Pritchard | |
| 4,526,628 | A | 7/1985 | Ohno et al. | |
| 4,564,392 | A | 1/1986 | Ohhashi et al. | |
| 4,629,218 | A | 12/1986 | Dubois | |
| 4,710,245 | A | 12/1987 | Roether | |
| 4,721,536 | A | 1/1988 | Koch et al. | |
| 4,812,182 | A | 3/1989 | Fang et al. | |
| 4,814,141 | A | 3/1989 | Imai et al. | |
| 5,191,911 | A | 3/1993 | Dubois | |
| 5,328,158 | A | 7/1994 | Lewis et al. | |
| 5,352,406 | A | 10/1994 | Barteri et al. | |
| 5,454,883 | A | 10/1995 | Yoshie et al. | |
| 5,538,566 | A | 7/1996 | Gallagher | |
| 5,592,988 | A | 1/1997 | Meroni et al. | |
| 5,598,735 | A | 2/1997 | Saito et al. | |
| 5,879,474 | A | 3/1999 | Bhadeshia et al. | |
| 5,944,921 | A | 8/1999 | Cumino et al. | |
| 5,993,570 | A | 11/1999 | Gray | |
| 6,006,789 | A | 12/1999 | Toyooka et al. | |
| 6,030,470 | A | 2/2000 | Hensger et al. | |
| 6,188,037 | B1 | 2/2001 | Hamada et al. | |
| 6,196,530 | B1 | 3/2001 | Muhr et al. | |
| 6,217,676 | B1 | 4/2001 | Takabe et al. | |
| 6,248,187 | B1 | 6/2001 | Asahi et al. | |
| 6,267,828 | B1 | 7/2001 | Kushida et al. | |
| 6,311,965 | B1 | 11/2001 | Muhr et al. | |
| 6,331,216 | B1 * | 12/2001 | Toyooka et al. | 148/320 |
| 6,358,336 | B1 * | 3/2002 | Miyata | C21D 1/28 148/328 |
| 6,384,388 | B1 | 5/2002 | Anderson et al. | |
| 6,514,359 | B2 | 2/2003 | Kawano | |
| 6,527,056 | B2 | 3/2003 | Newman | |
| 6,632,296 | B2 | 10/2003 | Yoshinaga et al. | |
| 6,648,991 | B2 | 11/2003 | Turconi et al. | |
| 6,669,285 | B1 | 12/2003 | Park et al. | |
| 6,669,789 | B1 | 12/2003 | Edelman et al. | |
| 6,682,610 | B1 | 1/2004 | Inoue | |
| 6,683,834 | B2 | 1/2004 | Ohara et al. | |
| 6,709,534 | B2 | 3/2004 | Kusinski et al. | |
| 6,767,417 | B2 | 7/2004 | Fujita et al. | |
| 6,958,099 | B2 | 10/2005 | Nakamura et al. | |
| 7,074,283 | B2 | 7/2006 | Omura | |
| 7,083,686 | B2 | 8/2006 | Itou | |
| 7,118,637 | B2 | 10/2006 | Kusinski et al. | |
| 7,182,140 | B2 | 2/2007 | Wood | |
| 7,214,278 | B2 | 5/2007 | Kusinski et al. | |
| 7,264,684 | B2 | 9/2007 | Numata et al. | |
| 7,635,406 | B2 | 12/2009 | Numata et al. | |
| 7,744,708 | B2 | 6/2010 | López et al. | |
| 7,862,667 | B2 | 1/2011 | Turconi et al. | |
| 8,002,910 | B2 | 8/2011 | Tivelli et al. | |
| 8,007,601 | B2 | 8/2011 | López et al. | |
| 8,007,603 | B2 | 8/2011 | Garcia et al. | |
| 8,016,362 | B2 | 9/2011 | Itoga | |
| 8,317,946 | B2 | 11/2012 | Arai et al. | |
| 8,328,958 | B2 | 12/2012 | Turconi et al. | |
| 8,328,960 | B2 | 12/2012 | Gomez et al. | |
| 8,414,715 | B2 | 4/2013 | Altschuler et al. | |
| 8,636,856 | B2 | 1/2014 | Altschuler et al. | |
| 8,821,653 | B2 * | 9/2014 | Anelli et al. | 148/335 |
| 8,926,771 | B2 | 1/2015 | Agazzi | |
| 9,163,296 | B2 | 10/2015 | Valdez et al. | |
| 9,222,156 | B2 | 12/2015 | Altschuler et al. | |
| 2001/0035235 | A1 | 11/2001 | Kawano | |
| 2002/0011284 | A1 | 1/2002 | Von Hagen et al. | |
| 2003/0019549 | A1 | 1/2003 | Turconi et al. | |
| 2003/0111146 | A1 | 6/2003 | Kusinski et al. | |
| 2003/0116238 | A1 | 6/2003 | Fujita | |
| 2003/0155052 | A1 | 8/2003 | Kondo et al. | |
| 2003/0165098 | A1 | 9/2003 | Ohara et al. | |
| 2004/0118490 | A1 | 6/2004 | Klueh et al. | |
| 2004/0131876 | A1 | 7/2004 | Ohgami et al. | |
| 2004/0139780 | A1 | 7/2004 | Cai et al. | |
| 2005/0076975 | A1 | 4/2005 | Lopez et al. | |
| 2005/0087269 | A1 | 4/2005 | Merwin | |
| 2006/0124211 | A1 | 6/2006 | Takano et al. | |
| 2006/0137781 | A1 | 6/2006 | Kusinski et al. | |
| 2006/0157539 | A1 | 7/2006 | Dubois | |
| 2006/0169368 | A1 | 8/2006 | Lopez et al. | |
| 2006/0231168 | A1 | 10/2006 | Nakamura et al. | |
| 2006/0243355 | A1 | 11/2006 | Haiderer et al. | |
| 2007/0089813 | A1 | 4/2007 | Tivelli | |
| 2007/0137736 | A1 | 6/2007 | Omura et al. | |
| 2007/0216126 | A1 | 9/2007 | Lopez et al. | |
| 2008/0047635 | A1 | 2/2008 | Kondo et al. | |
| 2008/0115863 | A1 | 5/2008 | McCrink et al. | |
| 2008/0129044 | A1 | 6/2008 | Carcagno et al. | |
| 2008/0219878 | A1 | 9/2008 | Konda et al. | |
| 2008/0226396 | A1 | 9/2008 | Garcia et al. | |
| 2008/0226491 | A1 | 9/2008 | Satou et al. | |
| 2008/0257459 | A1 | 10/2008 | Arai et al. | |
| 2008/0314481 | A1 | 12/2008 | Garcia et al. | |
| 2009/0010794 | A1 | 1/2009 | Lopez et al. | |
| 2009/0047166 | A1 * | 2/2009 | Tomomatsu et al. | 420/83 |
| 2009/0101242 | A1 | 4/2009 | Lopez et al. | |
| 2009/0226491 | A1 | 9/2009 | Satou et al. | |
| 2010/0068549 | A1 | 3/2010 | Agazzi | |
| 2010/0136363 | A1 | 6/2010 | Valdez et al. | |
| 2010/0193085 | A1 | 8/2010 | Garcia | |
| 2010/0294401 | A1 | 11/2010 | Gomez | |
| 2010/0319814 | A1 | 12/2010 | Perez | |
| 2010/0327550 | A1 | 12/2010 | Lopez | |
| 2011/0097235 | A1 | 4/2011 | Turconi et al. | |
| 2011/0247733 | A1 | 10/2011 | Arai et al. | |
| 2011/0259482 | A1 | 10/2011 | Peters et al. | |

(56) References Cited

U.S. PATENT DOCUMENTS

| | | | |
|---|---|---|---|
| 2011/0284137 | A1 | 11/2011 | Kami et al. |
| 2012/0018056 | A1 | 1/2012 | Nakagawa et al. |
| 2012/0199255 | A1 | 8/2012 | Anelli |
| 2012/0204994 | A1 | 8/2012 | Anelli |
| 2012/0211132 | A1 | 8/2012 | Altschuler |
| 2012/0267014 | A1 | 10/2012 | Hitoshio et al. |
| 2013/0000790 | A1 | 1/2013 | Arai et al. |
| 2013/0004787 | A1 | 1/2013 | Ishiyama et al. |
| 2013/0199674 | A1 | 8/2013 | Altschuler et al. |
| 2013/0264123 | A1 | 10/2013 | Altschuler |
| 2014/0057121 | A1 | 2/2014 | Altschuler |
| 2014/0137992 | A1 | 5/2014 | Ishiguro et al. |
| 2014/0251512 | A1 | 9/2014 | Gomez |
| 2014/0272448 | A1 | 9/2014 | Valdez et al. |
| 2014/0299235 | A1 | 10/2014 | Anelli |
| 2014/0299236 | A1 | 10/2014 | Anelli |
| 2016/0024625 | A1 | 1/2016 | Valdez |
| 2016/0102856 | A1 | 4/2016 | Minami |

FOREIGN PATENT DOCUMENTS

| | | | |
|---|---|---|---|
| CN | 1487112 | | 4/2004 |
| CN | 1292429 | | 12/2006 |
| CN | 101480671 | | 7/2009 |
| CN | 101542002 | | 9/2009 |
| CN | 101613829 | A | 12/2009 |
| CN | 101413089 | | 11/2010 |
| EA | 010037 | | 6/2008 |
| EA | 012256 | | 8/2009 |
| EP | 0 092 815 | | 11/1983 |
| EP | 0 658 632 | | 6/1995 |
| EP | 0 753 595 | | 1/1997 |
| EP | 0 788 850 | | 8/1997 |
| EP | 0 828 007 | A | 3/1998 |
| EP | 0 828007 | A | 3/1998 |
| EP | 0 989 196 | | 3/2000 |
| EP | 01027944 | B1 | 8/2000 |
| EP | 828 007 | | 11/2001 |
| EP | 1 277 848 | | 1/2003 |
| EP | 1 288 316 | | 3/2003 |
| EP | 1 413 639 | | 4/2004 |
| EP | 1 717 324 | | 11/2006 |
| EP | 1 914 324 | | 4/2008 |
| EP | 2 028 284 | | 2/2009 |
| EP | 2133442 | A1 | 12/2009 |
| EP | 2 239 343 | | 10/2010 |
| GB | 498 472 | | 1/1939 |
| JP | 60-086209 | | 5/1985 |
| JP | 60174822 | A | 9/1985 |
| JP | 60-215719 | | 10/1985 |
| JP | 60-215719 | A | 10/1985 |
| JP | 36025719 | | 10/1985 |
| JP | 61270355 | | 11/1986 |
| JP | 63004046 | A2 | 1/1988 |
| JP | 63004047 | A2 | 1/1988 |
| JP | 63230847 | A2 | 9/1988 |
| JP | 63230851 | A2 | 9/1988 |
| JP | 01 259124 | A2 | 10/1989 |
| JP | 01 259125 | A2 | 10/1989 |
| JP | 01 283322 | A2 | 11/1989 |
| JP | 05-098350 | | 12/1990 |
| JP | 403006329 | A | 1/1991 |
| JP | 04 021718 | A2 | 1/1992 |
| JP | 04 107214 | | 4/1992 |
| JP | 04 231414 | A2 | 8/1992 |
| JP | 05 287381 | A2 | 11/1993 |
| JP | 06-093339 | | 4/1994 |
| JP | 06 172859 | A2 | 6/1994 |
| JP | 06-220536 | | 8/1994 |
| JP | 07 041856 | A2 | 2/1995 |
| JP | 07 197125 | A2 | 8/1995 |
| JP | 08 311551 | | 11/1996 |
| JP | 09 067624 | A2 | 3/1997 |
| JP | 09-235617 | | 9/1997 |
| JP | 10 140250 | | 5/1998 |
| JP | 10176239 | | 6/1998 |
| JP | 10 280037 | A | 10/1998 |
| JP | 11 050148 | A | 2/1999 |
| JP | 11140580 | | 5/1999 |
| JP | 11229079 | | 8/1999 |
| JP | 2000-063940 | | 2/2000 |
| JP | 2000-178645 | | 6/2000 |
| JP | 2000-248337 | A | 9/2000 |
| JP | 2000-313919 | A2 | 11/2000 |
| JP | 2001-131698 | | 5/2001 |
| JP | 2001-164338 | | 6/2001 |
| JP | 2001-172739 | A2 | 6/2001 |
| JP | 2001-271134 | | 10/2001 |
| JP | 2002-096105 | A2 | 4/2002 |
| JP | 2004-011009 | | 1/2004 |
| JP | 60 174822 | | 9/2005 |
| KR | 0245031 | | 3/2000 |
| KZ | 1418 | B | 12/1994 |
| KZ | 2506 | B | 9/1995 |
| KZ | 2673 | B | 12/1995 |
| UA | 51138 | A | 11/2002 |
| WO | WO 96/22396 | | 7/1996 |
| WO | WO 00/70107 | | 11/2000 |
| WO | WO 01/88210 | | 11/2001 |
| WO | WO 03/033856 | | 4/2003 |
| WO | WO 2004/031420 | | 4/2004 |
| WO | WO 2004/097059 | A1 | 11/2004 |
| WO | WO 2006/009142 | | 1/2006 |
| WO | WO 2006/078768 | | 7/2006 |
| WO | WO 2007/017161 | | 2/2007 |
| WO | WO 2007/034063 | | 3/2007 |
| WO | WO 2008/003000 | | 1/2008 |
| WO | WO 2008/127084 | A2 | 10/2008 |
| WO | WO 2009/044297 | | 4/2009 |
| WO | WO 2009/065432 | | 5/2009 |
| WO | WO 2010/061882 | | 6/2010 |
| WO | WO 2011/152240 | | 12/2011 |
| WO | WO 2013/007729 | | 1/2013 |

OTHER PUBLICATIONS

Asahi, et al., Development of Ultra-high-strength Linepipe, X120, Nippon Steel Technical Report, Jul. 2004, Issue 90, pp. 82-87.

Fang, Hong-Sheng, et al.: "The Developing Prospect of Air-cooled Baintitic Steels", International Journal of Issi, vol. 2, No. 2, Feb. 1, 2005, pp. 9-18.

Mehling, Wilfred L.: "Hot Upset Forging," ASM Handbook vol. 14, 1998, pp. 84-95.

Turconi, G. L.: "Improvement of resistance to SSC initiation and propagation of high strength OCTG through microstruture and precipitation control"; "Paper 01077", NACE International, Houston, TX, Mar. 16, 2001. (XP009141583).

Italian Search Report and Written Opinion re IT Application No. IT MI20110180, completed Sep. 1, 2011, printed date Sep. 2, 2011.

Italian Search Report and Written Opinion re IT Application No. IT MI20110179, completed Aug. 31, 2011, printed date Sep. 2, 2011.

"Seamless Steel Tubes for Pressure Purposes—Technical Delivery Conditions—Part 1: Non-alloy Steel Tubes with Specified Room Temperature Properties" British Standard BS EN 10216-1:2002 E:1-26, published May 2002.

"Seamless Steel Tubes for Pressure Purposes—Technical Delivery Conditions—Part 2: Non-alloy and Alloy Steel Tubes with Specified Elevated Temperature Properties" British Standard BS EN 10216-2:2002+A2:2007:E:1-45, published Aug. 2007.

"Seamless Steel Tubes for Pressure Purposes—Technical Delivery Conditions—Part 3: Alloy Fine Grain Steel Tubes" British Standard BS EN 10216-3:2002 +A1:2004 E:1-34, published Mar. 2004.

"Seamless Steel Tubes for Pressure Purposes—Technical Delivery Conditions—Part 4: Non-alloy and Alloy Steel Tubes with Specified Low Temperature Properties" British Standard BS EN 10216-4:2002 + A1:2004 E:1-30, published Mar. 2004.

Aggarwal, R. K., et al.: "Qualification of Solutions for Improving Fatigue Life at SCR Touch Down Zone", Deep Offshore Technology Conference, Nov. 8-10, 2005, Vitoria, Espirito Santo, Brazil, in 12 pages.

(56) References Cited

OTHER PUBLICATIONS

Anelli, E., D. Colleluori, M. Pontremoli, G. Cumino, A. Izquierdo, H. Quintanilla, "Metallurgical design of advanced heavy wall seamless pipes for deep-water applications", 4th International Conference on Pipeline Technology, May 9 to 13, 2004, Ostend, Belgium.
ASM Handbook, Mechanical Tubing and Cold Finishing, Metals Handbook Desk Edition, (2000), 5 pages.
Bai M., D. Liu, Y. Lou, X. Mao, L. Li, X. Huo, "Effects of Ti addition on low carbon hot strips produced by CSP process", Journal of University of Science and Technology Beijing, 2006, vol. 13, N° 3, p. 230.
Beretta, Stefano et al., "Fatigue Assessment of Tubular Automotive Components in Presence of Inhomogeneities", Proceedings of IMECE2004, ASME International Mechanical Engineering Congress, Nov. 13-19, 2004, pp. 1-8.
Berner, Robert A., "Tetragonal Iron Sulfide", Science, Aug. 31, 1962, vol. 137, Issue 3531, pp. 669.
Berstein et al.,"The Role of Traps in the Microstructural Control of Hydrogen Embrittlement of Steels" Hydrogen Degradation of Ferrous Alloys, Ed. T. Oriani, J. Hirth, and M. Smialowski, Noyes Publications, 1988, pp. 641-685.
Boulegue, Jacques, "Equilibria in a sulfide rich water from Enghien-les-Bains, France", Geochimica et Cosmochimica Acta, Pergamom Press, 1977, vol. 41, pp. 1751-1758, Great Britain.
Bruzzoni et al., "Study of Hydrogen Permeation Through Passive Films on Iron Using Electrochemical Impedance Spectroscopy", PhD Thesis, 2003, Universidad Nacional del Comahue de Buenos Aires, Argentina.
Cancio et al., "Characterization of microalloy precipitates in the austenitic range of high strength low alloy steels", Steel Research, 2002, vol. 73, pp. 340-346.
Carboni, A., A. Pigani, G. Megahed, S. Paul, "Casting and rolling of API X 70 grades for artic application in a thin slab rolling plant", Stahl u Eisen, 2008, N° 1, p. 131-134.
Chang, L.C., "Microstructures and reaction kinetics of bainite transformation in Si-rich steels," XP0024874, Materials Science and Engineering, vol. 368, No. 1-2, Mar. 15, 2004, pp. 175-182, Abstract, Table 1.
Clark, A. Horrell, "Some Comments on the Composition and Stability Relations of Mackinawite", Neues Jahrbuch fur Mineralogie, 1966, vol. 5, pp. 300-304, London, England.
Craig, Bruce D., "Effect of Copper on the Protectiveness of Iron Sulfide Films", Corrosion, National Association of Corrosion Engineers, 1984, vol. 40, Issue 9, pp. 471-474.
D.O.T. 178.68 Spec. 39, pp. 831-840, Non reusable (non refillable) cylinders, Oct. 1, 2002.
De Medicis, Rinaldo, "Cubic FeS, A Metastable Iron Sulfide", Science, American Association for the Advancement of Science, Steenbock Memorial Library, Dec. 11, 1970, vol. 170, Issue 3963, pp. 723-728.
Echaniz, G., Morales, C., Perez, T., "Advances in Corrosion Control and Materials in Oil and Gas Production" Papers from Eurocorr 97 and Eurocorr 98, 13, P. S. Jackman and L.M. Smith, Published for the European Federation of Corrosion, No. 26, European Federation of Corrosion Publications, 1999.
Gojic, Mirko and Kosec, Ladislav, , "The Susceptibility to the Hydrogen Embrittlement of Low Alloy Cr and CrMo Steels", ISIJ International, 1997, vol. 37, Issue 4, pp. 412-418.
Heckmann, et al., Development of low carbon Nb—Ti—B microalloyed steels for high strength large diameter linepipe, Ironmaking and Steelmaking, 2005, vol. 32, Issue 4, pp. 337-341.
Howells, et al.: "Challenges for Ultra-Deep Water Riser Systems", IIR, London, Apr. 1997, 11 pages.
Hutchings et al., "Ratio of Specimen thickness to charging area for reliable hydrogen permeation measurement", British Corrosion. Journal, 1993, vol. 28, Issue 4, pp. 309-312.
Iino et al., "Aciers pour pipe-lines resistant au cloquage et au criquage dus a l'hydrogene", Revue de Metallurgie, 1979, vol. 76, Issue 8-9, pp. 591-609.
Ikeda et al., "Influence of Environmental Conditions and Metallurgical Factors on Hydrogen Induced Cracking of Line Pipe Steel", Corrosion/80, National Association of Corrosion Engineers, 1980, vol. 8, pp. 8/1-8/18, Houston, Texas.
Izquierdo, et al.: "Qualification of Weldable X65 Grade Riser Sections with Upset Ends to Improve Fatigue Performance of Deepwater Steel Catenary Risers", Proceedings of the Eighteenth International Offshore and Polar Engineering Conference, Vancouver, BC, Canada, Jul. 6-11, 2008, p. 71.
Johnston, P. W., G.Brooks, "Effect of Al2O3 and TiO2 Additions on the Lubrication Characteristics of Mould Fluxes", Molten Slags, Fluxes and Salts '97 Conference, 1997 pp. 845-850.
Keizer, Joel, "Statistical Thermodynamics of Nonequilibrium Processes", Spinger-Verlag, 1987.
Kishi, T., H.Takeucgi, M.Yamamiya, H.Tsuboi, T.Nakano, T.Ando, "Mold Powder Technology for Continuous Casting of Ti-Stabilized Stainless Steels", Nippon Steel Technical Report, No. 34, Jul. 1987, pp. 11-19.
Korolev, D. F., "The Role of Iron Sulfides in the Accumulation of Molybdenum in Sedimentary Rocks of the Reduced Zone", Geochemistry, 1958, vol. 4, pp. 452-463.
Lee, Sung Man and Lee, Jai Young, "The Effect of the Interface Character of TiC Particles on Hydrogen Trapping in Steel", Acta Metall., 1987, vol. 35, Issue 11, pp. 2695-2700.
Mishael, et al., "Practical Applications of Hydrogen Permeation Monitoring," Corrosion, Mar. 28-Apr. 1, 2004, Corrosion 2004, Nacional Association of Corrosion Engineers, Vol. Reprint No. 04476.
Morice et al., "Moessbauer Studies of Iron Sulphides", J. Inorg. Nucl. Chem., 1969, vol. 31, pp. 3797-3802.
Mukongo, T., P.C.Pistorius, and A.M.Garbers-Craig, "Viscosity Effect of Titanium Pickup by Mould Fluxes for Stainless Steel", Ironmaking and Steelmaking, 2004, vol. 31, No. 2, pp. 135-143.
Mullet et al., "Surface Chemistry and Structural Properties of Mackinawite Prepared by Reaction of Sulfide Ions with Metallic Iron", Geochemica et Cosmochemica Acta, 2002, vol. 66, Issue 5, pp. 829-836.
Murcowchick, James B. and Barnes, H.L., "Formation of a cubic FeS", American Mineralogist, 1986, vol. 71, pp. 1243-1246.
NACE MR0175/ISO 15156-1 Petroleum and natural gas industries—Materials for use in H2S-containing Environments in oil and gas production—Part 1: General principles for selection of cracking-resistant materials, Jun. 28, 2007.
Nagata, M., J. Speer, D. Matlock, "Titanium nitride precipitation behavior in thin slab cast high strength low alloyed steels", Metallurgical and Materials Transactions A, 2002 ,vol. 33A, p. 3099-3110.
Nakai et al., "Development of Steels Resistant to Hydrogen Induced Cracking in Wet Hydrogen Sulfide Environment", Transactions of the ISIJ, 1979, vol. 19, pp. 401-410.
Pressure Equipment Directive 97/23/EC, May 29, 1997, downloaded from website:http://ec.europa.eu/enterprise/pressure_equipment/ped/index_en.html on Aug. 4, 2010.
Prevéy, Paul, et al., "Introduction of Residual Stresses to Enhance Fatigue Performance in the Initial Design", Proceedings of Turbo Expo 2004, Jun. 14-17, 2004, pp. 1-9.
Rickard, D.T., "The Chemistry of Iron Sulphide Formation at Low Tempuratures", Stockholm Contrib. Geol., 1969, vol. 26, pp. 67-95.
Riecke, Ernst and Bohnenkamp, Konrad, "Uber den Einfluss von Gittersoerstellen in Eisen auf die Wassersroffdiffusion", Z. Metallkde . . . , 1984, vol. 75, pp. 76-81.
Shanabarger, M.R. and Moorhead, R. Dale, "H2O Adsorption onto clean oxygen covered iron films", Surface Science, 1996, vol. 365, pp. 614-624.
Shoesmith, et al., "Formation of Ferrous Monosulfide Polymorphs During Corrosion of Iron by Aqueous Hydrogen Sulfide at 21 degrees C", Journal of the Electrochemical Society, 1980, vol. 127, Issue 5, pp. 1007-1015.
Skoczylas, G., A.Dasgupta, R.Bommaraju, "Characterization of the chemical interactions during casting of High-titanium low carbon enameling steels", 1991 Steelmaking Conference Proceeding, pp. 707-717.

(56) References Cited

OTHER PUBLICATIONS

Smyth, D., et al.: Steel Tublar Products, Properties and Selection: Irons, Steels, and High-Performance Alloys, vol. 1, ASM Handbook, ASM International, 1990, p. 327-336.
Spry, Alan, "Metamorphic Textures", Perganom Press, 1969, New York.
Taira et al., "HIC and SSC Resistance of Line Pipes for Sour Gas Service", Nippon Kokan Technical Report, 1981, vol. 31, Issue 1-13.
Taira et al., "Study on the Evaluation of Environmental Condition of Wet Sour Gas", Corrosion 83 (Reprint. No. 156, National Association of Corrosion Engineers), 1983, pp. 156/2-156/13, Houston, Texas.
Takeno et al., "Metastable Cubic Iron Sulfide—With Special Reference to Mackinawite", American Mineralogist, 1970, vol. 55, pp. 1639-1649.
Tenaris Newsletter for Pipeline Services, Apr. 2005, p. 1-8.
Tenaris Newsletter for Pipeline Services, May 2003, p. 1-8.
Thethi, et al.: "Alternative Construction for High Pressure High Temperature Steel Catenary Risers", OPT USA, Sep. 2003, p. 1-13.
Thewlis, G., Weldability of X100 linepipe, Science and Technology of Welding and Joining, 2000, vol. 5, Issue 6, pp. 365-377.
Tivelli, M., G. Cumino, A. Izquierdo, E. Anelli, A. Di Schino, "Metallurgical Aspects of Heavy Wall—High Strength Seamless Pipes for Deep Water Applications", RioPipeline 2005, Oct. 17 to 19, 2005, Rio (Brasil), Paper n° IBP 1008_05.
Todoroki, T. Ishii, K. Mizuno, A. Hongo, "Effect of crystallization behavior of mold flux on slab surface quality of a Ti-bearing Fe—Cr—Ni super alloy cast by means of continuous casting process", Materials Science and Engineering A, 2005, vol. 413-414, p. 121-128.
Vaughan, D. J. and Ridout, M.S., "Moessbauer Studies of Some Sulphide Minerals", J. Inorg Nucl. Chem., 1971, vol. 33, pp. 741-746.
Wegst, C.W., "Stahlüssel", Auflage 1989, Seite 119, 2 pages.
Chinese Office Action App No. 201210026833.6 dated Jan. 16, 2015.
Office Action from Kazakhstan for Application No. 2012/1514.1 dated Jun. 25, 2013.
New steels and alloys in mechanical engineering / ed. Yu.M. Lakhtin, Ja.D. Kogan—M: Mechanical Engineering, 1976, p. 19.
Chitwood, G. B., et al.: "High-Strength Coiled Tubing Expands Service Capabilities", as presented at the 24th Annual OTC in Houston, Texas, May 4-7, 1992, in 15 pages.
Drill Rod Joint Depth Capacity Chart, downloaded Jan. 15, 2013; http://www.boartlongyear.com/drill-rod-joint-depth-capacity-chart.
Fratini et al.: "Improving friction stir welding of blanks of different thicknesses," Materials Science and Engineering A 459 (2007).
Holloman, J.H., et al., Time-tempered Relations in Tempering Steel. New York Meeting, pp. 223-249, 1945.
International Standard Publication. Petroleum and natural gas industries—Materials for use in H2Scontaining environments in oil and gas production. ANSI/NACE ISO, 145 pages, 2009.
Nandan et al.: "Recent advances in friction-stir welding—Process, weldment structure and properties," Progress in Materials Science 53 (2008) 980-1023.
Pollack, Herman, W., Materials Science and Metallurgy, Fourth Edition, pp. 96 and 97, 1988.
Savatori et al. European Commision Report, EUR 2006, EUR2207, 3 pp. STN_Abstract.
Tenaris brochure. Coiled Tubes HS8OCRA, 2 pages, 2008.
Tenaris brochure. Coiled Tubes Suggested Field Welding Procedure (GTAW) for Coiled Tubing Grads HS70, HS80, HS90, HS110, 3 pages, 2007.
Tenaris brochure. Coiled Tubing for Down hole Applications, 10 pages, 2007.
Echaniz, "The effect of microstructure on the KISSC of low alloy carbon steels," NACE Corrosion '98, EE. UU., Mar. 1998, pp. 22-27, San Diego.
Jacobs, Lucinda and Emerson, Steven, "Trace Metal Solubility in an Anoxid Fjord," Earth and Planetary Sci. Letters, Elsevier Scientific Publishing Company, 1982, vol. 60, pp. 237-252, Amsterdam, Netherlands.

* cited by examiner

HIGH STRENGTH STEEL PIPES WITH EXCELLENT TOUGHNESS AT LOW TEMPERATURE AND SULFIDE STRESS CORROSION CRACKING RESISTANCE

CROSS-REFERENCE TO RELATED APPLICATIONS

This application claims priority to Italian Patent Application No. MI2011A000180, entitled "HIGH STRENGTH STEEL PIPES WITH EXCELLENT TOUGHNESS AT LOW TEMPERATURE AND SULFIDE STRESS CORROSION CRACKING RESISTANCE", filed Feb. 7, 2011. This application is also related to U.S. patent application Ser. No. 13/367,312, entitled "HEAVY WALL STEEL PIPES WITH EXCELLENT TOUGHNESS AT LOW TEMPERATURE AND SULFIDE STRESS CORROSION CRACKING RESISTANCE", filed Feb. 6, 2012. The entirety of each of these applications is hereby incorporated by reference and should be considered a part of this specification.

BACKGROUND OF THE INVENTION

Field

Embodiments of the present disclosure relate generally to metal production and, in certain embodiments, relates to methods of producing metallic tubular bars having high toughness at low temperature while concurrently possessing sulfide stress corrosion cracking resistance. Certain embodiments relate to seamless steel pipes for risers of all kinds (catenary, hybrid, top tension, work over, drilling, etc.), line pipes and flow lines for use in the oil and gas industry, including pipes that are suitable for bending.

Description of the Related Art

A core component in deep and ultra-deep sea production is the circulation of fluids from the seafloor to the surface system. Risers, the pipes which connect the drilling or production platform to the well, are exposed over considerable length (now exceeding roughly 10,000 feet, or approximately 2 miles) to the straining pressures of multiple ocean currents.

Riser system costs are quite sensitive to water depth. Although in-service conditions and the sensitiveness of environmental loads (i.e. wave and current) are different for the for the different riser types—Top Tension Risers (TTRs) and Steel Catenary Risers (SCRs), Hybrid Risers (HRs), Work over (WORs) and Drilling Risers (DRs)—reducing the raiser weight may provide significant benefits. For example, by reducing the weight of the line, it is anticipated that a decrease in the cost of the pipe and a significant impact on the tensioning system used to support the riser may be achieved. For at least these reasons, high strength steels, with yield stresses of about 70 ksi (485 MPa) and above, may be candidates for development of lighter risers in the offshore sector.

However, steels with specified minimum yield strength (SMYS) exceeding about 70 ksi can suffer sulfide stress corrosion (SSC) induced failures as a result of hydrogen embrittlement under stress. Therefore, it is difficult to meet the NACE requirement for sour service materials (e.g., NACE MR0175/ISO 15156-1 "Petroleum and natural gas industries—Materials for use in $H_2S$-containing Environments in oil and gas production—Part 1: General principles for selection of cracking-resistant materials) and to pass SSC testing (e.g., NACE Standard TM0177 "Laboratory testing of metals for resistance to sulfide stress cracking and stress corrosion cracking in $H_2S$ environments").

While major seamless line pipe manufacturers are able to manufacture high strength materials with minimum yield strength equal or above about 70 ksi, resistance to SSC and hydrogen induced cracking (HIC) (this latter assessed according with NACE Standard TM0284, "Evaluation of pipeline and pressure vessel steels for resistance to hydrogen induced cracking") of these high grades is often not adequate. Currently, only grades up to X70 are rated for sour service according to ISO 3183.

Moreover, increased strength may lead to more brittle behavior at lower temperatures. In general the materials are qualified at so-called "design temperatures", which typically lie at about 20° C. below minimum expected service and/or ambient temperature. The lowest ambient temperature on the Norwegian continental shelf is about −20° C. In the Arctic regions, minimum ambient temperatures well below −40° C. are expected. Consequently, minimum design temperatures down to approximately −60° C. are desired.

However, line pipe steels with yield stresses of about 70 ksi and above are today qualified for design temperatures only down to about −40° C. This limitation could limit cost-effective oil and gas exploration in arctic and arctic-like regions. Therefore new high strength steel pipes with improved toughness at temperatures equal or less than about −60° C. are desirable.

SUMMARY

Embodiments of the present disclosure are directed to steel pipes or tubes and methods of manufacturing the same. In some embodiments, seamless quenched and tempered steel pipes for riser and line pipes are provided having wall thickness (WT) between about 8 to about 35 mm with a minimum yield strength of about 485 MPa (70 ksi), about 550 MPa (80 ksi), and about 625 MPa (90 ksi), respectively, with excellent low temperature toughness and corrosion resistance (sour service, $H_2S$ environment). The seamless pipes are also suitable to produce bends of the same grade by hot induction bending and off-line quenching and tempering treatments. In one embodiment, the steel pipe may have an outside diameter (OD) between about 6" (152 mm) and about 28" (711 mm), and wall thickness (WT) from about 8 to about 35 mm.

In one embodiment, the composition of a seamless, low-alloy steel pipe may comprise (by weight):

about 0.05% to about 0.16% C;
about 0.20% to about 0.90% Mn;
about 0.10% to about 0.50% Si;
about 1.20% to about 2.60% Cr;
about 0.05% to about 0.50% Ni;
about 0.80% to about 1.20% Mo;
about 0.03% Nb maximum;
about 0.02% Ti maximum;
about 0.005% to about 0.12% V;
about 0.008% to about 0.040% Al;
about 0.0030-0.012% N;
about 0.3% Cu maximum;
about 0.01% S maximum;
about 0.02% P maximum;
about 0.001 to about 0.005% Ca;
about 0.0020% B maximum;
about 0.020% As maximum;
about 0.0050% Sb maximum;
about 0.020% Sn maximum;
about 0.030% Zr maximum;
about 0.030% Ta maximum;
about 0.0050% Bi maximum;

about 0.0030% O maximum;

about 0.00030% H maximum;

where the balance of the composition may comprise iron and inevitable impurities.

Embodiments of the steel pipes may be manufactured into different grades. In one embodiment, a 485 MPa (70 ksi) grade steel pipe may be provided with the following properties:

Yield strength (YS): about 485 MPa (70 ksi) minimum and about 635 MPa (92 ksi) maximum.

Ultimate Tensile Strength (UTS): about 570 MPa (83 ksi) minimum and about 760 MPa (110 ksi) maximum.

Elongation, not less than about 20%.

YS/UTS ratio no higher than about 0.93.

In another embodiment, a 555 MPa (80 ksi) grade steel pipe may be provided with the following properties:

Yield strength (YS): about 555 MPa (80 ksi) minimum and about 705 MPa (102 ksi) maximum.

Ultimate Tensile Strength (UTS): about 625 MPa (90 ksi) minimum and about 825 MPa (120 ksi) maximum.

Elongation, not less than about 20%.

YS/UTS ratio no higher than about 0.93.

In another embodiment, a 625 MPa (90 ksi) grade steel pipe may be provided with the following properties:

Yield strength (YS): about 625 MPa (90 ksi) minimum and about 775 MPa (112 ksi) maximum.

Ultimate Tensile Strength (UTS): about 695 MPa (100 ksi) minimum and about 915 MPa (133 ksi) maximum.

Elongation, not less than about 18%.

YS/UTS ratio no higher than about 0.95.

The steel pipe may have a minimum impact energy of about 250 J/about 200 J (average/individual) and a minimum average shear area of about 80% for both longitudinal and transverse Charpy V-notch (CVN) tests performed at about −70° C. according to standard ISO 148-1. In one embodiment, the 80 ksi grade pipe may have a hardness of about 248 $HV_{10}$ maximum. In another embodiment, the 90 ksi grade pipe may have a hardness of 270 $HV_{10}$ maximum.

Steel pipes manufactured according to embodiments of the invention may exhibit resistance to both hydrogen induced cracking (HIC), as well as sulfide stress corrosion (SSC) cracking. In one embodiment, HIC tests were performed according to NACE Standard TM0284-2003 Item No. 21215, using NACE solution A, and conducted for a test duration of about 96 hours. Under these conditions, the steel pipe samples exhibited the following HIC parameters, averaged on three sections of three test specimens:

Crack Length Ratio, CLR≤5%

Crack Thickness Ratio, CTR≤1%

Crack Sensitivity Ratio, CSR≤0.2%

In another embodiment, SSC testing performed in accordance with NACE TM0177, using test solution A were conducted for a test duration of about 720 hours. Under these conditions, the steel pipe samples exhibited substantially no failure at 90% of SMYS for grades 70 ksi and 80 ksi and no failure at about 72% SMYS for 90 ksi grade.

Steel pipes manufactured according to certain embodiments of the disclosure may have a microstructure exhibiting substantially no ferrite, no upper bainite, and no granular bainite. They may comprise a microstructure of tempered martensite with a volume percentage greater than about 60%, preferably greater than about 90%, most preferably greater than about 95% (measured according with ASTM E562-08) and tempered lower bainite with volume percentage less than about 40%, preferably less than about 10%, most preferably less than 5%. Martensite and bainite may be formed at temperatures lower than about 450° C. and about 540° C. respectively, after re-heating at temperatures of about 900° C. to about 1060° C. for soaking times from about 300 sec to about 3600 sec, and quenching at cooling rates greater than about 20° C./s. The average prior austenite grain size measured by ASTM E112 standard is greater than about 15 μm or about 20 μm (lineal intercept) and smaller than about 100 μm.

In further embodiments, the packet size of the steel pipes after tempering may possess a packet size (i.e., the average size of regions separated by high angle boundaries smaller than about 6 μm. In further embodiments, the packet size may be smaller than about 4 μm. In other embodiments, the packet size may be smaller than about 3 μm. Packet size may be measured as the average lineal intercept on images taken by Scanning Electron Microscopy (SEM) using the Electron Back Scattered Diffraction (EBSD) signal, with high-angle boundaries considered to be those boundaries with a misorientation >45°.

In additional embodiments, the steel pipes after tempering may exhibit the presence of fine and coarse precipitates. The fine precipitates may be of the type MX, $M_2X$, where M is V, Mo, Nb, or Cr and X is C or N. The average diameter of the fine precipitates may be less than about 40 nm. The coarse precipitates may be of the type $M_3C$, $M_6C$, $M_{23}C_6$. The average diameter of the coarse precipitates may be within the range between about 80 nm to about 400 nm. The precipitates may be examined by Transmission Electron Microscopy (TEM) using the extraction replica method.

In an embodiment, a steel pipe is provided. The steel pipe may comprise a steel composition comprising:

about 0.05 wt. % to about 0.16 wt. % carbon;

about 0.20 wt. % to about 0.90 wt. % manganese;

about 0.10 wt. % to about 0.50 wt. % silicon;

about 1.20 wt. % to about 2.60 wt. % chromium;

about 0.05 wt. % to about 0.50 wt. % nickel;

about 0.80 wt. % to about 1.20 wt. % molybdenum;

about 0.005 wt. % to about 0.12 wt. % vanadium about 0.008 wt. % to about 0.04 wt. % aluminum;

about 0.0030 wt. % to about 0.0120 wt. % nitrogen; and about 0.0010 wt. % to about 0.005 wt. % calcium;

where the wall thickness of the steel pipe is greater than or equal to about 8 mm and less than about 35 mm. The steel pipe may be processed to have a yield strength greater than about 550 MPa (80 ksi) The microstructure of the steel tube may further comprises martensite in a volume percentage greater than or equal to about 60% and lower bainite in a volume percentage less than or equal to about 40%

In another embodiment, a method of making a steel pipe is provided. The method may comprise providing a steel having a steel composition (e.g., a low-alloy steel). The method may further comprise forming the steel into a tube having a wall thickness greater than or equal to about 8 mm and less than about 35 mm. The method may additionally comprise heating the formed steel tube in a first heating operation to a temperature within the range between about 900° C. to about 1060° C. The method also comprises quenching the formed steel tube at a cooling rate greater than or equal to about 20° C./sec, where the microstructure of the quenched steel comprises greater than or equal to about 60% martensite and less than or equal to about 40% lower bainite and has an average prior austenite grain size measured by ASTM E112 greater than about 15 μm. The method may additionally comprise tempering the quenched steel tube at a temperature within the range between about 680° C. to about 760° C., where, after tempering, the steel tube may have a yield strength greater than about 80 ksi and an average Charpy V-notch energy greater or equal to about 100

J/cm$^2$ at about −70° C. In other embodiments, the average Charpy V-notch energy of the steel tube is greater or equal to about 250 J/cm$^2$ at about −70° C.

In a further embodiment, a 550 MPa (80 ksi) grade seamless steel pipe is provided. The steel pipe may comprise:

about 0.10 wt. % to about 0.13 wt. % carbon;
about 0.40 wt. % to about 0.55 wt. % manganese;
about 0.20 wt. % to about 0.35 wt. % silicon;
about 1.9 wt. % to about 2.3 wt. % chromium;
about 0.9 wt. % to about 1.10 wt. % molybdenum;
about 0.001 wt. % to about 0.005 wt. % calcium;
about 0.050 wt. % to about 0.07 wt. % vanadium
about 0.010 wt. % to about 0.020 wt. % aluminum;

A wall thickness of the steel pipe may be greater than or equal to 8 mm and less than or equal to 35 mm. The steel pipe may be processed by hot rolling followed by cooling to room temperature heating to a temperature of about 900° C. or above, quenching at a cooling rate greater than or equal to 40° C./sec, and tempering at a temperature between 680° C. to 760° C. The processed steel pipe may have a microstructure comprising a prior austenite grain size of about 20 μm to about 80 μm, a packet size of about 3 μm to about 6 μm, about 90% martensite by volume or greater, and about 10% lower bainite by volume or less. The steel pipe may have a yield strength (YS) between about 550 MPa (80 ksi) and about 705 MPa (102 ksi), an ultimate tensile strength (UTS) between about 625 MPa (90 ksi) and about 825 MPa (120 ksi), elongation no less than about 20%, and a YS/UTS ratio no higher than about 0.93.

In another embodiment, a 625 MPa (90 ksi) grade seamless steel pipe is provided. The steel pipe may comprise:

about 0.10 wt. % to about 0.13 wt. % carbon;
about 0.40 wt. % to about 0.55 wt. % manganese;
about 0.20 wt. % to about 0.35 wt. % silicon;
about 1.90 wt. % to about 2.30 wt. % chromium;
about 0.9 wt. % to about 1.10 wt. % molybdenum;
about 0.001 wt. % to about 0.005 wt. % calcium;
about 0.050 wt. % to about 0.07 wt. % vanadium and
about 0.010 wt. % to about 0.020 wt. % aluminum;

A wall thickness of the steel pipe may be greater than or equal to 8 mm and less than or equal to 35 mm. The steel pipe may be processed by hot rolling followed by cooling to room temperature heating to a temperature of about 900° C. or above, quenching at a cooling rate greater than or equal to 20° C./sec, and tempering at a temperature between about 680° C. to about 760° C. The processed steel pipe may have a microstructure comprising a prior austenite grain size of about 20 nm to about 60 μm, a packet size of about 2 μm to about 6 μm, about 95% martensite by volume or greater, and about 5% lower bainite by volume or less. The steel pipe may also have a yield strength (YS) between about 625 MPa (90 ksi) and about 775 MPa (112 ksi), an ultimate tensile strength (UTS) between about 695 MPa (100 ksi) and about 915 MPa (133 ksi), elongation no less than about 18% and a YS/UTS ratio no higher than about 0.95.

In additional embodiments, a 485 MPa (70 ksi) grade seamless steel pipe is provided. The steel pipe may comprise:

about 0.10 wt. % to about 0.13 wt. % carbon;
about 0.40 wt. % to about 0.55 wt. % manganese;
about 0.20 wt. % to about 0.35 wt. % silicon;
about 2.00 wt. % to about 2.450 wt. % chromium;
about 0.9 wt. % to about 1.10 wt. % molybdenum; and
about 0.001 wt. % to about 0.005 wt. % calcium;

A wall thickness of the steel pipe may be greater than or equal to 8 mm and less than or equal to 35 mm. The steel pipe may be processed by hot rolling followed by cooling to room temperature, heating to a temperature of about 900° C. or above, quenching at a cooling rate greater than or equal to 20° C./sec, and tempering at a temperature between about 680° C. to about 760° C. The processed steel pipe may have a microstructure comprising an austenite grain size of about 20 μm to about 100 μm, a packet size of about 4 μm to about 6 μm, about 60% martensite by volume or greater, and about 40% lower bainite by volume or less. The steel pipe may have a yield strength (YS) between about 485 MPa (70 ksi) to about 635 MPa (92 ksi), an ultimate tensile strength (UTS) between about 570 MPa (83 ksi) to about 760 MPa (110 ksi), elongation no less than about 18% and a YS/UTS ratio no higher than about 0.93.

BRIEF DESCRIPTION OF THE DRAWINGS

Other features and advantages of the embodiments of the disclosure will be apparent from the following description taken in connection with the accompanying drawings.

DETAILED DESCRIPTION

Figure 1:
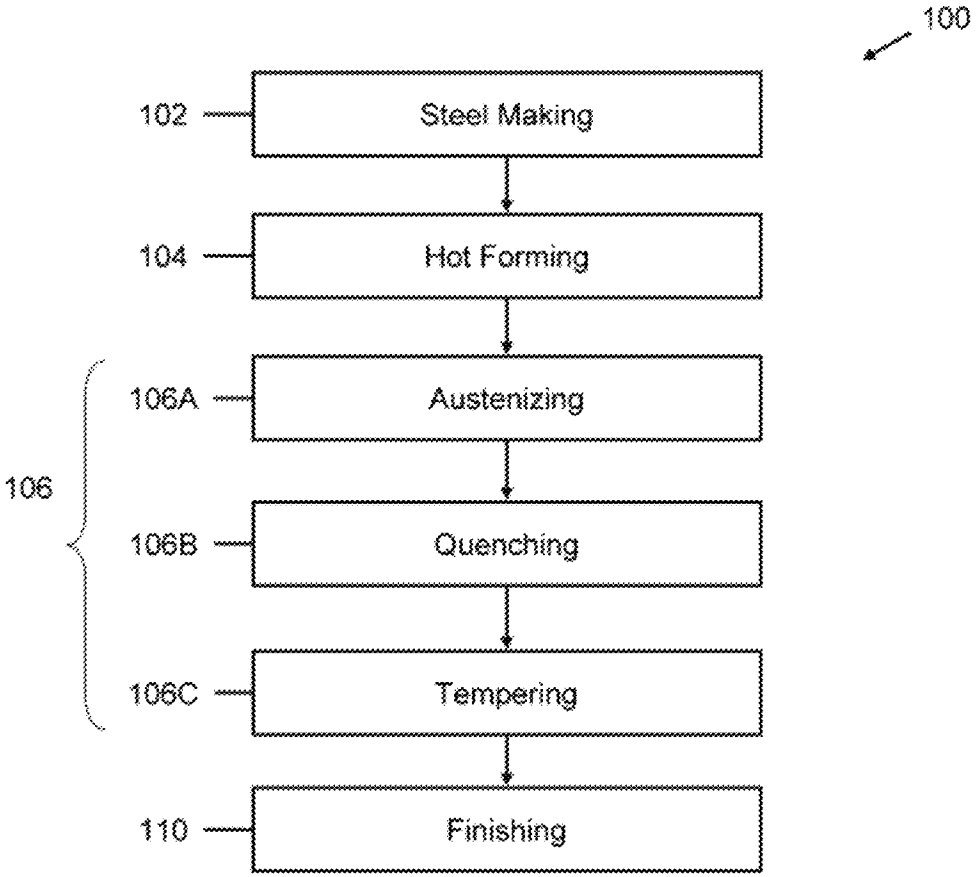
FIG. 1 is a schematic flow diagram illustrating one embodiment of a method for fabricating steel pipes.

Embodiments of the present disclosure provide steel compositions, tubular bars (e.g., pipes) formed using the steel compositions, and respective methods of manufacture. The tubular bars may be employed, for example, as line pipes and risers for use in the oil and gas industry. In certain embodiments, the tubular bars may possess wall thicknesses greater than or equal to about 8 mm and less than about 35 mm and a microstructure of martensite and lower bainite without substantial ferrite, upper bainite, or granular bainite. So formed, the tubular bars may possess a minimum yield strength of about 485 MPa (70 ksi), about 555 MPa (80 ksi), and about 625 MPa (90 ksi). In further embodiments, the tubular bars may possess good toughness at low temperatures and resistance to sulfide stress corrosion cracking (SSC) and hydrogen induced cracking (HIC), enabling use of the tubular bars in sour service environments. It may be understood, however, that tubular bars comprise one example of articles of manufacture which may be formed from embodiments of the present disclosure and should in no way be construed to limit the applicability of the disclosed embodiments.

The term "bar" as used herein is a broad term and may include its ordinary dictionary meaning and may also refer to a generally hollow, elongate member which may be straight or have bends or curves and be formed to a predetermined shape, and any additional forming required to secure the formed tubular bar in its intended location. The bar may be tubular, having a substantially circular outer surface and inner surface, although other shapes and cross-sections are contemplated as well. As used herein, the term "tubular" may refer to any elongate, hollow shape, which need not be circular or cylindrical.

The terms "approximately," "about," and "substantially," as used herein represent an amount close to the stated amount that still performs a desired function or achieves a desired result. For example, the terms "approximately," "about," and "substantially" may refer to an amount that is within less than 10% of, within less than 5% of, within less than 1% of, within less than 0.1% of, and within less than 0.01% of the stated amount.

The term "room temperature" as used herein has its ordinary meaning as known to those skilled in the art and may include temperatures within the range of about 16° C. (60° F.) to about 32° C. (90° F.).

Embodiments of the present disclosure comprise low-alloy carbon steel pipes and methods of manufacture. As discussed in greater detail below, through a combination of steel composition and heat treatment, a final microstructure may be achieved that provides selected mechanical properties of interest, including one or more of minimum yield strength, toughness, hardness and corrosion resistance, in high wall thickness pipes (e.g., WT greater than or equal to about 8 mm and less than about 35 mm).

The steel composition of the present disclosure may comprise not only carbon (C) but also manganese (Mn), silicon (Si), chromium (Cr), nickel (Ni), molybdenum (Mo), vanadium (V), aluminum (Al), nitrogen (N), and calcium (Ca). Additionally, one or more of the following elements may be optionally present and/or added as well: tungsten (W), niobium (Nb), titanium (Ti), boron (B), zirconium (Zr), and tantalum (Ta). The remainder of the composition may comprise iron (Fe) and impurities. In certain embodiments, the concentration of impurities may be reduced to as low an amount as possible. Embodiments of impurities may include, but are not limited to, copper (Cu), sulfur (S), phosphorous (P), arsenic (As), antimony (Sb), tin (Sn), bismuth (Bi), oxygen (O), and hydrogen (H).

For example, the low-alloy steel composition may comprise (in weight % unless otherwise noted):

Carbon within the range between about 0.05% to about 0.16%;

Manganese within the range between about 0.20% to about 0.90%;

Silicon within the range between about 0.10% to about 0.50%;

Chromium within the range between about 1.20% to about 2.60%;

Nickel within the range between about 0.050% to about 0.50%;

Molybdenum within the range between about 0.80% to about 1.20%;

Tungsten less than or equal to about 0.08%

Niobium less than or equal to about 0.030%;

Titanium less than or equal to about 0.020%;

Vanadium within the range between about 0.005% to about 0.12%;

Aluminum within the range between about 0.008% to about 0.040%;

Nitrogen within the range between about 0.0030% to about 0.012%;

Copper less than or equal to about 0.3%;

Sulfur less than or equal to about 0.01%;

Phosphorous less than or equal to about 0.02%;

Calcium within the range between about 0.001% to about 0.005%;

Boron less than or equal to about 0.0020%;

Arsenic less than or equal to about 0.020%;

Antimony less than or equal to about 0.005%;

Tin less than or equal to about 0.020%;

Zirconium less than or equal to 0.030%;

Tantalum less than or equal to 0.030%;

Bismuth less than about 0.0050%;

Oxygen less than about 0.0030%; and

Hydrogen less than or equal to about 0.00030%;

where the balance of the composition comprises iron and impurities.

The heat treatment operations may include, but are not limited to, quenching and tempering (Q+T). The quenching operation may include reheating a pipe from about room temperature after hot forming to a temperature that austenitizes the pipe followed by a rapid quench. For example, the pipe may be heated to a temperature within the range between about 900° C. to about 1060° C. and held at about the austenitizing temperature for a selected soaking time. Cooling rates during the quench are selected so as to achieve a selected cooling rate at about the mid-wall of the pipe. For example, pipes may be cooled so as to achieve cooling rates greater than or equal to about 20° C./s at about the mid-wall. In other embodiments, the cooling rate may be greater than or equal to about 40° C./sec, as discussed in greater detail below.

Quenching pipes having a WT greater than or equal to about 8 mm and less than about 35 mm and the composition described above may promote the formation of a volume percent of martensite greater than about 60%, preferably greater than about 90% and more preferably greater than about 95% within the pipe. In certain embodiments, the remaining microstructure of the pipe may comprise lower bainite, with substantially no ferrite, upper bainite, or granular bainite. In other embodiments, the microstructure of the pipe may comprise substantially 100% martensite.

Following the quenching operations, the pipe may be further subjected to tempering. Tempering may be conducted at a temperature within the range between about 680° C. to about 760° C., depending upon the composition of the steel and the target yield strength. In addition to the martensite and lower bainite, the microstructure may further exhibit an average prior austenite grain size measured according to ASTM E112 of between about 15 μm to about 100 μm. The microstructure may also exhibit an average packet size of less than or equal to about 6 μm, preferably less than or equal to about 4 μm, most preferably less than or equal to about 3 μm. The microstructure may further exhibit fine precipitates of any of MX, $M_2X$, where M is V, Mo, Nb, or Cr and X is C or N. The fine precipitates may further possess an average diameter less than or equal to about 40 nm. The coarse precipitates of any of $M_3C$, $M_6C$, and $M_{23}C_6$ may also be present. The coarse precipitates may further possess an average diameter between about 80 to about 400 nm.

In one embodiment, a steel pipe having a WT greater than or equal to about 8 mm and less than about 35 mm may be provided that comprises the composition and microstructure discussed above. Such steel pipes may possess the following properties:

Minimum Yield Strength (YS)=about 70 ksi (485 MPa)
Maximum Yield Strength=about 102 ksi (705 MPa)
Minimum Ultimate Tensile Strength (UTS)=about 90 ksi (625 MPa)
Maximum Ultimate Tensile Strength=about 120 ksi (825 MPa)
Elongation at failure=Greater than about 20%
YS/UTS=Less than or equal to about 0.93

In another embodiment, a steel pipe having a WT greater than or equal to about 8 mm and less than about 35 mm may be provided that comprises the composition and microstructure discussed above. Such steel pipes may possess the following properties:

Minimum Yield Strength (YS)=about 80 ksi (550 MPa)
Maximum Yield Strength=about 102 ksi (705 MPa)
Minimum Ultimate Tensile Strength (UTS)=about 90 ksi (625 MPa)
Maximum Ultimate Tensile Strength=about 120 ksi (825 MPa)
Elongation at failure=Greater than about 20%
YS/UTS=Less than or equal to about 0.93

In another embodiment, a steel pipe having a WT greater than or equal to about 8 mm and less than about 35 mm may be provided and may further possess the following properties:

Minimum Yield Strength (YS)=about 90 ksi (625 MPa)
Maximum Yield Strength=about 112 ksi (775 MPa)
Minimum Ultimate Tensile Strength (UTS)=about 100 ksi (695 MPa)
Maximum Ultimate Tensile Strength=about 133 ksi (915 MPa)
Elongation at failure=Greater than about 18%
YS/UTS=Less than or equal to about 0.95

In each of the above embodiments, the formed pipes may further exhibit the following impact and hardness properties:

Minimum Impact Energy (Average/Individual at about −70° C.):
=about 250 J/about 200 J (for 70 ksi and 80 ksi grades)
=about 150 J/about 100 J (for 90 ksi grade)
Average Shear Area (CVN at about −70° C.; ISO 148-1)
=about 80% minimum
Hardness
=about 248 $HV_{10}$ maximum (for 70 ksi and 80 ksi grades)
=about 270 $HV_{10}$ maximum (for 90 ksi grade)

In each of the above embodiments, formed pipe may further exhibit the following resistance to sulfide stress corrosion (SSC) cracking and hydrogen induced cracking (HIC). SSC testing may be conducted according to NACE TM 0177 using solution A for a test duration of about 720 hours. HIC testing may be conducted according to NACE TM 0284-2003 Item 21215 using NACE solution A for a test duration 96 hours:

HIC:
Crack Length Ratio, CLR=Less than or equal to about 5%
Crack Thickness Ratio, CTR=Less than or equal to about 1%
Crack Sensitivity Ratio, CSR=Less than or equal to about 0.2%

SSC:
Failure time at 90% specified minimum yield stress
=For 70 ksi and 80 ksi grades, greater than about 720 hours
Failure time at 72% specified minimum yield stress
=For 90 ksi grade, greater than about 720 hours With reference to FIG. 1, a flow diagram illustrating one embodiment of a method 100 for manufacturing tubular bars is shown. The method 100 may include steel making operations 102, hot forming operations 104, heat treatment operations 106, which may include austenitizing 106A, quenching 106B, tempering 106C, and finishing operations 110. It may be understood that the method 100 may include greater or fewer operations and the operations may be performed in a different order than that illustrated in FIG. 1, as necessary.

Operation 102 of the method 100 preferably comprises fabrication of the steel and production of a solid metal billet capable of being pierced and rolled to form a metallic tubular bar. In further embodiments, selected steel scrap, cast iron, and sponge iron may be employed to prepare the raw material for the steel composition. It may be understood, however, that other sources of iron and/or steel may be employed for preparation of the steel composition.

Primary steelmaking may be performed using an electric arc furnace to melt the steel, decrease phosphorous and other impurities, and achieve a selected temperature. Tapping and deoxidation, as well as addition of alloying elements may be further performed.

One of the main objectives of the steelmaking process is to refine the iron by removal of impurities. In particular, sulfur and phosphorous are prejudicial for steel because they degrade the mechanical properties of the steel. In one embodiment, secondary steelmaking may be performed in a ladle furnace and trimming station after primary steelmaking to perform specific purification steps.

During these operations, very low sulfur contents may be achieved within the steel, calcium inclusion treatment is performed, and inclusion flotation is performed. In one embodiment inclusion flotation may be performed by bubbling inert gases in the ladle furnace to force inclusions and impurities to float. This technique produces a fluid slag capable of absorbing impurities and inclusions. In this manner, a high quality steel having the desired composition with a low inclusion content may be provided.

Table 1 illustrates embodiments of the steel composition, in weight percent (wt. %) unless otherwise noted.

TABLE 1

Steel composition ranges

| | Composition Range | | | | | |
|---|---|---|---|---|---|---|
| | General | | More Preferred | | Most Preferred | |
| Element | Minimum | Maximum | Minimum | Maximum | Minimum | Maximum |
| C | 0.05 | 0.16 | 0.07 | 0.14 | 0.08 | 0.12 |
| Mn | 0.20 | 0.90 | 0.30 | 0.60 | 0.30 | 0.50 |

TABLE 1-continued

| Steel composition ranges | | | | | | |
|---|---|---|---|---|---|---|
| | Composition Range | | | | | |
| | General | | More Preferred | | Most Preferred | |
| Element | Minimum | Maximum | Minimum | Maximum | Minimum | Maximum |
| Si | 0.10 | 0.50 | 0.10 | 0.40 | 0.10 | 0.25 |
| Cr | 1.20 | 2.60 | 1.80 | 2.50 | 2.10 | 2.40 |
| Ni | 0.05 | 0.50 | 0.05 | 0.20 | 0.05 | 0.20 |
| Mo | 0.80 | 1.20 | 0.90 | 1.10 | 0.95 | 1.10 |
| W | 0.00 | 0.80 | 0.00 | 0.60 | 0.00 | 0.30 |
| Nb | 0.000 | 0.030 | 0.000 | 0.015 | 0.000 | 0.010 |
| Ti | 0.000 | 0.020 | 0.000 | 0.010 | 0.000 | 0.010 |
| V | 0.005 | 0.12 | 0.050 | 0.10 | 0.050 | 0.07 |
| Al | 0.008 | 0.040 | 0.010 | 0.030 | 0.015 | 0.025 |
| N | 0.0030 | 0.0120 | 0.0030 | 0.0100 | 0.0030 | 0.0080 |
| Cu | 0.00 | 0.30 | 0.00 | 0.20 | 0.00 | 0.15 |
| S | 0.000 | 0.010 | 0.000 | 0.005 | 0.000 | 0.003 |
| P | 0.000 | 0.020 | 0.000 | 0.012 | 0.000 | 0.010 |
| Ca | 0.0010 | 0.0050 | 0.0010 | 0.0030 | 0.0015 | 0.0030 |
| B | 0.0000 | 0.0020 | 0.0005 | 0.0012 | 0.0008 | 0.0014 |
| As | 0.000 | 0.020 | 0.000 | 0.015 | 0.000 | 0.015 |
| Sb | 0.0000 | 0.0050 | 0.0000 | 0.0050 | 0.0000 | 0.0050 |
| Sn | 0.000 | 0.020 | 0.000 | 0.015 | 0.000 | 0.015 |
| Zr | 0.000 | 0.030 | 0.000 | 0.015 | 0.000 | 0.010 |
| Ta | 0.000 | 0.030 | 0.000 | 0.015 | 0.000 | 0.010 |
| Bi | 0.0000 | 0.0050 | 0.0000 | 0.0050 | 0.0000 | 0.0050 |
| O | 0.000 | 0.0030 | 0.000 | 0.0020 | 0.000 | 0.0015 |
| H | 0.0000 | 0.00030 | 0.0000 | 0.00025 | 0.0 | 0.00020 |

Carbon (C) is an element whose addition to the steel composition may inexpensively raise the strength of the steel and refine the microstructure, reducing the transformation temperatures. In an embodiment, if the C content of the steel composition is less than about 0.05%, it may be difficult in some embodiments to obtain the strength desired in articles of manufacture, particularly tubular products. On the other hand, in other embodiments, if the steel composition has a C content greater than about 0.16%, in some embodiments, toughness is impaired, and weldability may decrease, making more difficult and expensive any welding process if joining is not performed by thread joints. In addition, the risk of developing quenching cracks in steels with high hardenability increases with the Carbon content. Therefore, in an embodiment, the C content of the steel composition may be selected within the range between about 0.05% to about 0.16%, preferably within the range between about 0.07% to about 0.14%, and more preferably within the range between about 0.08% to about 0.12%.

Manganese (Mn) is an element whose addition to the steel composition may be effective in increasing the hardenability, strength and toughness of the steel. In an embodiment, if the Mn content of the steel composition is less than about 0.20% it may be difficult in some embodiments to obtain the desired strength in the steel. However, in another embodiment, if the Mn content exceeds about 0.90%, in some embodiments banding structures may become marked in some embodiments, and toughness and HIC/SSC resistance may decrease. Therefore, in an embodiment, the Mn content of the steel composition may be selected within the range between about 0.20% to about 0.90%, preferably within the range between about 0.30% to about 0.60%, and more preferably within the range between about 0.30% to about 0.50%.

Silicon (Si) is an element whose addition to the steel composition may have a deoxidizing effect during steel making process and may also raise the strength of the steel (e.g., solid solution strengthening). In an embodiment, if the Si content of the steel composition is less than about 0.10%, the steel in some embodiments may be poorly deoxidized during steelmaking process and exhibit a high level of micro-inclusions. In another embodiment, if the Si content of the steel composition exceeds about 0.50%, both toughness and formability of the steel may decrease in some embodiments. Si content within the steel composition higher than about 0.5% is also recognized to have a detrimental effect on surface quality when the steel is processed at high temperatures (e.g., temperatures greater than about 1000° C.) in oxidizing atmospheres, because surface oxide (scale) adherence is increased due to fayalite formation and the risk of surface defect is higher. Therefore, in an embodiment, the Si content of the steel composition may be selected within the range between about 0.10% to about 0.50%, preferably within the range between about 0.10% to about 0.40%, and more preferably within the range between about 0.10% to about 0.25%.

Chromium (Cr) is an element whose addition to the steel composition may increase hardenability, decrease transformation temperatures, and increase tempering resistance of the steel. Therefore the addition of Cr to steel compositions may be desirable for achieving high strength and toughness levels. In an embodiment, if the Cr content of the steel composition is less than about 1.2%, it may be difficult in to obtain the desired strength and toughness, some embodiments. In another embodiment, if the Cr content of the steel composition exceeds about 2.6%, the cost may be excessive and toughness may decrease due to enhanced precipitation of coarse carbides at grain boundaries, in some embodiments. In addition, weldability of the resultant steel may be reduced, making the welding process more difficult and expensive, if joining is not performed by thread joints. Therefore, in an embodiment, the Cr content of the steel composition may be selected within the range between about 1.2% to about 2.6%, preferably within the range between about 1.8% to about 2.5%, and more preferably within the range between about 2.1% to about 2.4%.

Nickel (Ni) is an element whose addition to the steel composition may increase the strength and toughness of the steel. However, in an embodiment, when Ni addition exceeds about 0.5%, a negative effect on scale adherence has been observed, with higher risk of surface defect formation. Also, in other embodiments, Ni content within the steel composition higher than about 1% is recognized to have a detrimental effect on sulfide stress corrosion cracking. Therefore, in an embodiment, the Ni content of the steel composition may vary within the range between about 0.05% to about 0.5%, more preferably within the range between about 0.05% to about 0.2%.

Molybdenum (Mo) is an element whose addition to the steel composition may improve hardenability and hardening by solid solution and fine precipitation. Mo may assist in retarding softening during tempering, promoting the formation of very fine MC and $M_2C$ precipitates. These particles may be substantially uniformly distributed in the matrix and may also act as beneficial hydrogen traps, slowing down the atomic hydrogen diffusion towards the dangerous traps, usually at grain boundaries, which behave as crack nucleation sites. Mo also reduces the segregation of phosphorous to grain boundaries, improving resistance to inter-granular fracture, with beneficial effects also on SSC resistance because high strength steels which suffer hydrogen embrittlement exhibit an intergranular fracture morphology. Therefore, by increasing the Mo content of the steel composition, the desired strength can be achieved at higher tempering temperatures, which promote better toughness levels. In an embodiment, in order to exert the effect thereof, the Mo content of the steel composition may be greater than or equal to about 0.80%. However, in other embodiments, when the Mo content within the steel composition is higher than about 1.2% a saturation effect on hardenability is noted and weldability may be reduced. As Mo ferroalloy is expensive, in an embodiment, the Mo content of the steel composition may be selected within the range between about 0.8 to about 1.2%, preferably within the range between about 0.9% to about 1.1%, and more preferably within the range between about 0.95% to about 1.1%.

Tungsten (W) is an element whose addition to the steel composition is optional and may increase the strength at room and elevated temperatures by forming tungsten carbide which develops secondary hardening. W is preferably added when the steel use is required at high temperatures. The behavior of W is similar to that of Mo in terms of hardenability but its effectiveness is about one half of that of Mo. Tungsten reduces the steel oxidation and, as a result, less scale may be formed during reheating processes at high temperatures. However, as its cost is very high, in an embodiment, the W content of the steel composition may selected to be less than or equal to about 0.8%.

Niobium (Nb) is an element whose addition to the steel composition is optional and may be provided to form carbides and nitrides and may be further used to refine the austenitic grain size during hot rolling and re-heating before quenching. However Nb may not be needed in embodiments of present steel composition to refine the austenite grains as a predominant martensite structure is formed and a fine packet is formed even in the case of coarse austenite grains when low transformation temperatures are promoted through a proper balance of other chemical elements such as Cr, Mo, and C.

Nb precipitates as carbonitride may increase the steel strength by particle dispersion hardening. These fine and round particles may be substantially uniformly distributed in the matrix and also act as hydrogen traps, beneficially slowing down the atomic hydrogen diffusion towards the dangerous traps, usually at grain boundaries, which behave as crack nucleation sites. In an embodiment, if the Nb content of the steel composition is higher than about 0.030%, a coarse precipitate distribution that impair toughness may be formed. Therefore, in an embodiment, the Nb content of the steel composition may be selected to be less than or equal to about 0.030%, preferably less than or equal to about 0.015%, and more preferably less than or equal to about 0.01%.

Titanium (Ti) is an element whose addition to the steel composition is optional and may be provided to refine austenitic grain size in high temperature processes, forming nitrides and carbonitrides. However it is not needed in embodiments of present steel composition, except when it is used to protect boron that remains in solid solution improving hardenability, especially in the case of pipes with wall thickness greater than about 25 mm. For example, Ti may bind nitrogen and substantially inhibit BN formation. Additionally, in certain embodiments, when Ti is present in concentrations higher than about 0.02%, coarse TiN particles may be formed that impair toughness. Accordingly, in an embodiment, the Ti content of the steel composition may be less than or equal to about 0.02%, and more preferably less than or equal to about 0.01% when boron is below about 0.0010%.

Vanadium (V) is an element whose addition to the steel composition may increase strength by carbonitride precipitation during tempering. These fine and round particles may also be substantially uniformly distributed within the matrix and act as beneficial hydrogen traps. In an embodiment, if the V content is less than about 0.05%, it may be in some embodiments difficult to obtain the desired strength. However, in another embodiment, if the V content of the steel composition is higher than about 0.12%, a large volume fraction of vanadium carbide particles may be formed with subsequent reduction in toughness. Therefore, in certain embodiments, the Nb content of the steel composition may be selected to be less than or equal to about 0.12%, preferably within the range between about 0.05% to about 0.10%, and more preferably within the range between about 0.05% to about 0.07%.

Aluminum (Al) is an element whose addition to the steel composition has a deoxidizing effect during steel making process and may refine the steel grain. In an embodiment, if the Al content of the steel composition is higher than about 0.040%, coarse precipitates of AlN that impair toughness and/or Al-rich oxides (e.g., non-metallic inclusions) that impair HIC and SSC resistance may be formed. Accordingly, in an embodiment, the Al content of the steel composition may be selected to be less than or equal to about 0.04%, preferably less than or equal to about 0.03%, and more preferably less than or equal to about 0.025%.

Nitrogen (N) is an element whose content within the steel composition is preferably selected to be greater than or equal to about 0.0030%, in one embodiment, in order to form carbonitrides of V, Nb, Mo and Ti. However, in other embodiments, if the N content of the steel composition exceeds about 0.0120%, the toughness of the steel may be degraded. Therefore, the N content of the steel composition may be selected within the range between about 0.0030% to about 0.0120%, preferably within the range between about 0.0030% to about 0.0100%, and more preferably within the range between about 0.0030% to about 0.0080%.

Copper (Cu) is an impurity element that is not needed in embodiments of the steel composition. However, depending on the manufacturing process, the presence of Cu may be unavoidable. Therefore, the Cu content within the steel composition may be limited to as low as possible. For example, in an embodiment, the Cu content of the steel composition may be less than or equal to about 0.3%, preferably less than or equal to about 0.20%, and more preferably less than or equal to about 0.15%.

Sulfur (S) is an impurity element that may decrease both toughness and workability of the steel, as well as HIC/SSC resistance. Accordingly, the S content of the steel composition, in some embodiments, may be kept as low as possible. For example, in an embodiment, the Cu content of the steel composition may be less than or equal to about 0.01%, preferably less than or equal to about 0.005%, and more preferably less than or equal to about 0.003%.

Phosphorous (P) is an impurity element that may cause the toughness and HIC/SSC resistance of high strength steel to decrease. Accordingly, the P content of the steel composition, in some embodiments, may be kept as low as possible. For example, in an embodiment, the P content of the steel composition may be less than or equal to about 0.02%, preferably less than or equal to about 0.012%, and more preferably less than or equal to about 0.010%.

Calcium (Ca) is an element whose addition to the steel composition may assist with control of the shape of inclusions and enhancement of the HIC resistance by forming fine and substantially round sulfides. In an embodiment, in order to provide these benefits, the Ca content of the steel composition may be selected to be greater than or equal to about 0.0010% when the sulfur content of the steel composition is higher than about 0.0020%. However in other embodiments, if the Ca content of the steel composition exceeds about 0.0050% the effect of the Ca addition may be saturated and the risk of forming clusters of Ca-rich non-metallic inclusions that reduce HIC and SSC resistance may be increased. Accordingly, in certain embodiments, the maximum Ca content of the steel composition may be selected to be less than or equal to about 0.0050%, and more preferably less than or equal to about 0.0030%, while the minimum Ca content may be selected to be greater than or equal to about 0.0010%, and most preferably to greater than or equal to about 0.0015%.

Boron (B) is an element whose addition to the steel composition is optional and may be provided for improving the hardenability of the steel. B can be used for inhibiting ferrite formation. In an embodiment, the lower limit of the B content of the steel composition to provide these beneficial effects may be about 0.0005%, while the beneficial effects may be saturated with boron contents higher than about 0.0020%. Therefore, in selected embodiments, the B content of the steel composition may vary within the range between about 0 to about 0.0020%, more preferably within the range between about 0.0005 to about 0.0012%, and most preferably within the range between about 0.0008 to about 0.0014%.

Arsenic (As), tin (Sn), antimony (Sb) and bismuth (Bi) are impurity elements that are not needed in embodiments of the steel composition. However, depending on the manufacturing process, the presence of these impurity elements may be unavoidable. Therefore, the As and Sn contents within the steel composition may be selected to be less than or equal to about 0.020%, and more preferably less than or equal to about 0.015%. The respective Sb and Bi content may each be independently selected to be less than or equal to about 0.0050%.

Zirconium (Zr) and tantalum (Ta) are elements that act as strong carbide and nitride formers, similar to Nb and Ti. These elements may be optionally added to the steel composition, as they are not needed in embodiments of present steel composition to refine the austenite grains. Zr and Ta fine carbonitrides may increase the steel strength by particle dispersion hardening and may also act as beneficial hydrogen traps, slowing down the atomic hydrogen diffusion towards the dangerous traps. In an embodiment, if the Zr or Ta content is greater than or equal to about 0.030%, a coarse precipitate distribution that may impair toughness of the steel may be formed. Zirconium may also act as a deoxidizing element in steel and combines with the sulfur. However, in certain embodiments, as an addition to steel in order to promote globular non-metallic inclusions, Ca may be preferred. Therefore, the content of Zr and Ta within the steel composition may each be independently selected to be less than or equal to about 0.03%.

The total oxygen (O) content of the steel composition is the sum of the soluble oxygen and the oxygen in the non-metallic inclusions (oxides). As it is practically the oxygen content in the oxides in a well deoxidized steel, an oxygen content that is too high means a high volume fraction of non-metallic inclusions and less resistance to HIC and SSC. Accordingly, in an embodiment, the oxygen content of the steel may be selected to be less than or equal to about 0.0030%, preferably less than or equal to about 0.0020%, and more preferably less than or equal to about 0.0015%.

Following the production of the fluid slag having a composition as described above, the steel may be cast into a round solid billet having a substantially uniform diameter along the steel axis. For example, round billets having a diameter within the range between about 330 mm to about 420 mm may be produced in this manner.

The billet thus fabricated may be formed into a tubular bar through hot forming processes 104. In an embodiment, a solid, cylindrical billet of clean steel may be heated to a temperature of about 1200° C. to about 1340° C., preferably about 1280° C. For example, the billet may be reheated by a rotary heath furnace. The billet may be further subject to a rolling mill. Within the rolling mill, the billet may be pierced, in certain preferred embodiments utilizing the Manessmann process, and hot rolling is used to substantially reduce the outside diameter and wall thickness of the tube, while the length is substantially increased. In certain embodiments, the Manessmann process may be performed at temperatures within the range between about 1200° C. to about 1280° C. The obtained hollow bars may be further hot rolled at temperatures within the range between about 1000° C. to about 1200° C. in a retained mandrel continuous mill. Accurate sizing may be carried out by a sizing mill and the seamless tubes cooled in air to about room temperature in a cooling bed. For example, pipes with outer diameters (OD) within the range between about 6 inches to about 16 inches may be formed in this manner.

After rolling the pipes may be in-line heated, without cooling at room temperature, by an intermediate furnace for making temperature more uniform, and accurate sizing may be carried out by a sizing mill. Subsequently, the seamless pipes may be cooled in air down to room temperature in a cooling bed. In the case of a pipe having a final OD greater than about 16 inches, the pipes produced by the medium size mill may be processed by a rotary expansion mill. For example, medium size pipes may be reheated by a walking beam furnace to a temperature within the range between about 1150° C. to about 1250° C., expanded to the desired diameter by the expander mill at a temperature within the range between about 1100° C. to about 1200° C., and in-line reheated before final sizing.

In a non-limiting example, a solid bar may be hot formed as discussed above into a tube possessing an outer diameter within the range between about 6 inches to about 16 inches and a wall thickness greater than or equal to about 8 mm and less than about 35 mm.

The final microstructure of the formed pipe may be determined by the composition of the steel provided in operation 102 and heat treatments performed in operations 106. The composition and microstructure, in turn, may give rise to the properties of the formed pipe.

In one embodiment, promotion of martensite formation may refine the packet size (the size of the regions separated by high-angle boundaries that offer higher resistance to crack propagation; the higher the misorientation, the higher the energy a crack requires to cross the boundary) and improve the toughness of the steel pipe for a given yield strength. Increasing the amount of martensite in as-quenched pipes may further allow the use of higher tempering temperatures for a given strength level. In further embodiments, higher strength levels may be achieved for a given tempering temperature by replacing bainite with martensite in the as-quenched pipe. Therefore, in an embodiment, it is a goal of the method to achieve a predominantly martensitic microstructure at relatively low temperatures (e.g., transformation of austenite at temperatures less than or equal to about 450° C.). In an embodiment, the martensitic microstructure may comprise a volume percent of martensite greater than or equal to about 60%. In further embodiments, the volume percent of martensite may be greater than or equal to about 90%. In further embodiments, the volume percent of martensite may be greater than or equal to about 95%.

In another embodiment, hardenability of the steel, the relative ability of the steel to form martensite when quenched, may be improved through the composition and microstructure. In one aspect, addition of elements such as Cr and Mo are effective in reducing the transformation temperature of martensite and bainite and increase the resistance to tempering. Beneficially, a higher tempering temperature may then be used to achieve a given strength level (e.g., yield strength). In another aspect, a relatively coarse austenite grain size (e.g., about 15 μm to about 100 μm) may improve hardenability.

In a further embodiment, the sulfide stress corrosion cracking (SSC) resistance of the steel may be improved through the composition and microstructure. In one aspect, the SSC may be improved by increased content of martensite within the pipe. In another aspect, tempering at very high temperatures may improve the SSC of the pipe, as discussed in greater detail below.

In order to promote martensite formation at temperatures less than or equal to about 450° C., the steel composition may further satisfy Equation 1, where the amounts of each element are given in wt. %:

$$60C\ \%+Mo\ \%+1.7Cr\ \%>10 \qquad \text{Eq. 1}$$

If a significant amount of bainite (e.g., less than about 40 volume %) is present after quenching, the temperature at which the bainite forms should be less than or equal to about 540° C. in order to promote a relatively fine packet, with substantially no upper bainite or granular bainite (a mixture of bainitic dislocated-ferrite and islands of high C martensite and retained austenite).

In order to promote the bainite formation at a temperature less than or equal to about 540° C. (e.g., lower bainite), the steel composition may additionally satisfy Equation 2, where the amounts of each element are given in wt. %:

$$60C\ \%+41Mo\ \%+34Cr\ \%>70 \qquad \text{Eq. 2}$$

Figure 2:
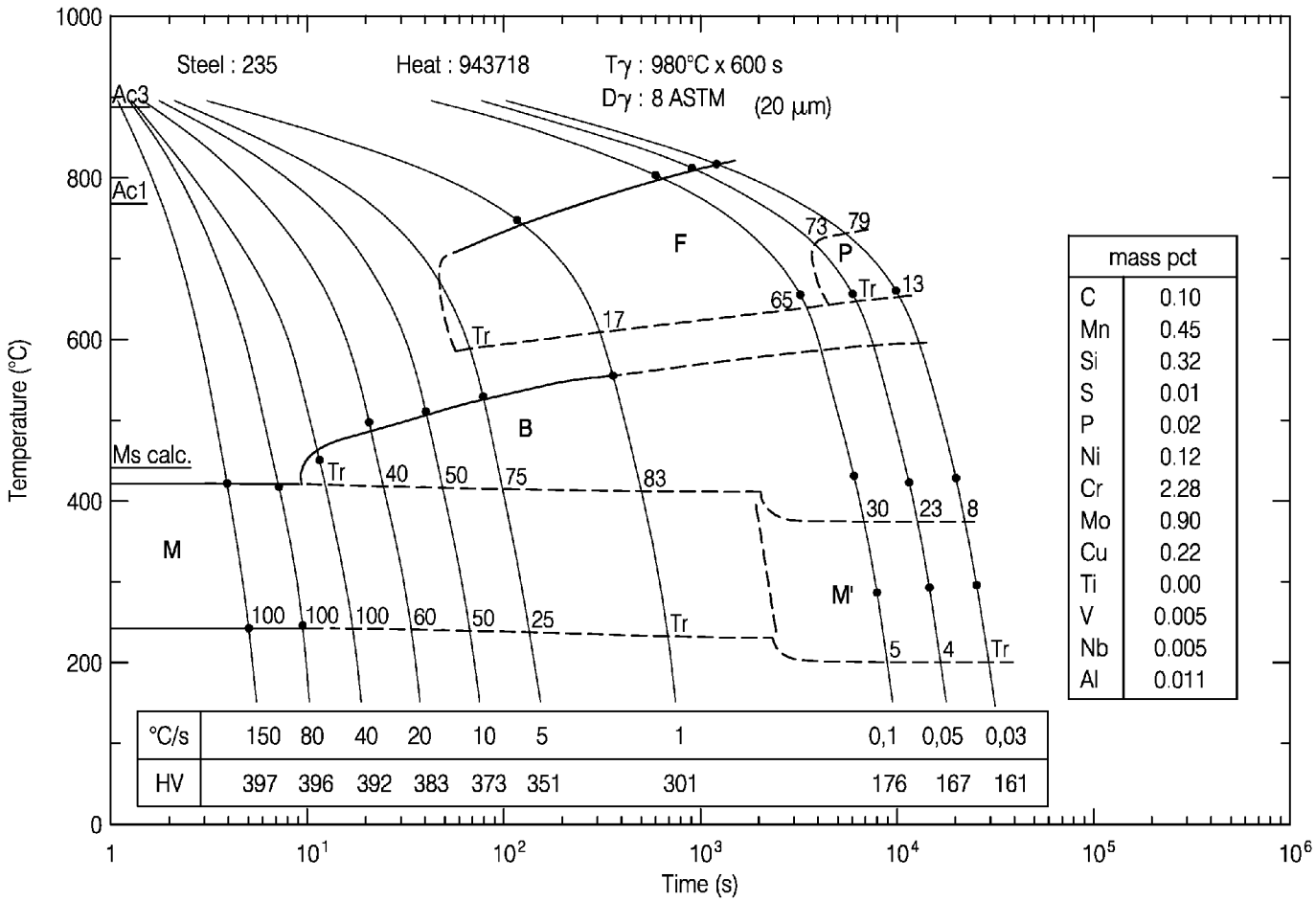
FIG. 2 is an embodiment of a continuous cooling transformation (CCT) diagram for an embodiment of a steel of the present disclosure.

FIG. 2 illustrates a Continuous Cooling Transformation (CCT) diagram of a steel with composition within the ranges illustrated in Table 1 generated by dilatometry. FIG. 2 indicates that, even in the case of high Cr and Mo contents, in order to substantially avoid the formation of ferrite and have an amount of martensite greater than or equal to about 50% in volume, an average austenite grain size (AGS) greater than about 20 μm and a cooling rate greater than or equal to about 20° C./s may be employed. Furthermore, in order to provide a microstructure of approximately 100% martensite, a cooling rate greater than or equal to about 40° C./s may be employed.

Notably, normalizing, (e.g., austenitizing followed by cooling in still air), may not achieve the desired martensite microstructure because the typical average cooling rates between about 800° C. and 500° C. for pipes of wall thickness between about 8 mm and about 35 mm is lower than about 5° C./s. Water quenching may be employed to achieve the desired cooling rates at about the pipe mid-wall and form martensite and lower bainite at temperatures lower than about 450° C. and about 540° C., respectively. Therefore, the as-rolled pipes may be reheated in a furnace and water quenched in quenching operation 106A after air cooling from hot rolling.

For example, in one embodiment of the austenitizing operations 106A, the temperatures of the zones of the furnace may be selected in order to allow the pipe to achieve the target austenitizing temperature with a tolerance lower than about +/−20° C. Target austenitizing temperatures may be selected within the range between about 900° C. to about 1060° C. The heating rate may be selected within the range between about 0.1° C./s to about 0.3° C./s. The soaking time, the time from when the pipe achieves the final target temperature minus about 10° C. and the exit from the furnace, may be selected within the range between about 300 sec to about 3600 sec. Austenitizing temperatures and holding times may be selected depending on chemical composition, wall thickness, and desired austenite grain size. At the exit of the furnace, the pipe may be descaled to remove the surface oxide and is rapidly moved to a water quenching system.

In the quenching operations 106B, external and internal cooling may be employed to achieve the desired cooling rates at about the mid-wall of the pipe (e.g., greater than about 20° C./s). As discussed above, cooling rates within this range may promote the formation of a volume percent of martensite greater than about 60%, preferably greater than about 90%, and more preferably greater than about 95%. The remaining microstructure may comprise lower bainite, (i.e. bainite formed at temperatures lower than about 540° C. with a typical morphology including fine precipitation within the bainite laths, without coarse precipitates at lath boundaries as in the case of upper bainite, which is usually formed at temperatures higher than about 540° C.).

In one embodiment, the water quench of quenching operations 106B may be performed by dipping the pipe in a tank containing stirred water. The pipe may be rapidly rotated during quenching to make the heat transfer high and uniform and avoid pipe distortion. Additionally, in order to remove the steam developed inside the pipe, an inner water jet may also be employed. In certain embodiments, the water temperature may not be higher than about 40° C., preferably less than about 30° C. during quenching operations 106B.

After quenching operations 106B, the pipe may be introduced in another furnace for the tempering operations 106C.

In certain embodiments, the tempering temperature may be selected to be sufficiently high so as to produce a relatively low dislocation density matrix and more carbides with a substantially round shape (i.e., a higher degree of spheroidization). This spheroidization improves the impact toughness of the pipes, as needle shaped carbides at lath and grain boundaries may provide easier crack paths.

Tempering the martensite at temperatures sufficiently high to produce more spherical, dispersed carbides may promote trans-granular cracking and better SSC resistance. Crack propagation may be slower in steels that possess a high number of hydrogen trapping sites and fine, dispersed precipitates having spherical morphologies give better results.

By forming a microstructure including tempered martensite, as opposed to a banded microstructure (e.g., ferrite-pearlite or ferrite-bainite), the HIC resistance of the steel pipe may be further increased.

In one embodiment, the tempering temperature may be selected within the range between about 680° C. to about 760° C. depending on the chemical composition of the steel and the target yield strength. The tolerances for the selected tempering temperature may be within the range of about ±15° C. The pipe may be heated at a rate between about 0.1° C./s to about 0.3° C./s to the selected tempering temperature. The pipe may be further held at the selected tempering temperature for a duration of time within the range between about 600 sec to about 4800 sec.

Notably, the packet size is not significantly influenced by the tempering operations 106C. However, packet size may decrease with a reduction of the temperature at which austenite transforms. In traditional low-carbon steels with carbon equivalents lower than about 0.43%, tempered bainite may show a coarser packet size (e.g., about 7 μm to about 12 μm) as compared with that of the tempered martensite within the instant application (e.g. less than or equal to about 6 μM, such as from within the range about 6 μm to about 2 μm).

The martensite packet size is nearly independent of the average austenite grain size and may remain fine (e.g., an average size less than or equal to about 6 μm) even in the case of relatively coarse average austenite grain size (e.g., about 15 μm or about 20 μm to about 100 μm).

Finishing operations 110 may include, but are not limited to, straightening and bending operations. Straightening may be performed at temperatures below about the tempering temperature and above about 450° C.

In one embodiment, bending may be performed by hot induction bending. Hot induction bending is a hot deformation process which concentrates in a narrow zone, referred to as hot tape, that is defined by an induction coil (e.g., a heating ring) and a quenching ring that sprays water on the external surface of the structure to be bent. A straight (mother) pipe is pushed from its back, while the front of the pipe is clamped to an arm constrained to describe a circular path. This constraint provokes a bending moment on the entire structure, but the pipe is plastically deformed substantially only within correspondence of the hot tape. The quenching ring may, therefore, play two simultaneous roles: (i) to define the zone under plastic deformation and (ii) to in-line quench the hot bend.

The diameter of both the heating and quenching rings is about 20 mm to about 60 mm larger than the outside diameter (OD) of the mother pipe. The bending temperature at both exterior and interior surfaces of the pipe may be continuously measured by pyrometers.

In conventional pipe fabrication, the bends may be subjected to a stress relieving treatment after bending and quenching by a tempering treatment at a relatively low temperature to achieve the final mechanical properties. However, it is recognized that the in-line quenching and tempering operations performed during finishing operations 110 may produce a microstructure that is different than that obtained from the off-line quenching and tempering operations 106B, 106C. Therefore, in an embodiment of the disclosure, an off-line quenching and tempering treatment may be performed as discussed above in operations 106B, 106C, in order to substantially regenerate the microstructure obtained after operations 106B, 106C. Therefore, the bends may be reheated in a furnace and then rapidly immersed into a quenching tank with stirred water and then tempered in a furnace.

In certain embodiments, during quenching in the water, the pipe may rotate and water may flow inside the pipe using a nozzle while, during quenching, the bend may be fixed and no nozzle is used. Therefore the quenching effectiveness for the bend may be slightly lower. In further embodiments, the heating rates during austenitizing and tempering may also be slightly different as furnaces with different performances/productivities can be used.

In an embodiment, the temper after bending may be performed at a temperature within the range between about 650° C. to about 760° C. The pipe may be heated at a rate within the range between about 0.05° C./s to about 0.3° C./s. A hold time within the range between about 600 sec to about 3600 sec may be employed after the target tempering temperature has been achieved.

Figure 3:
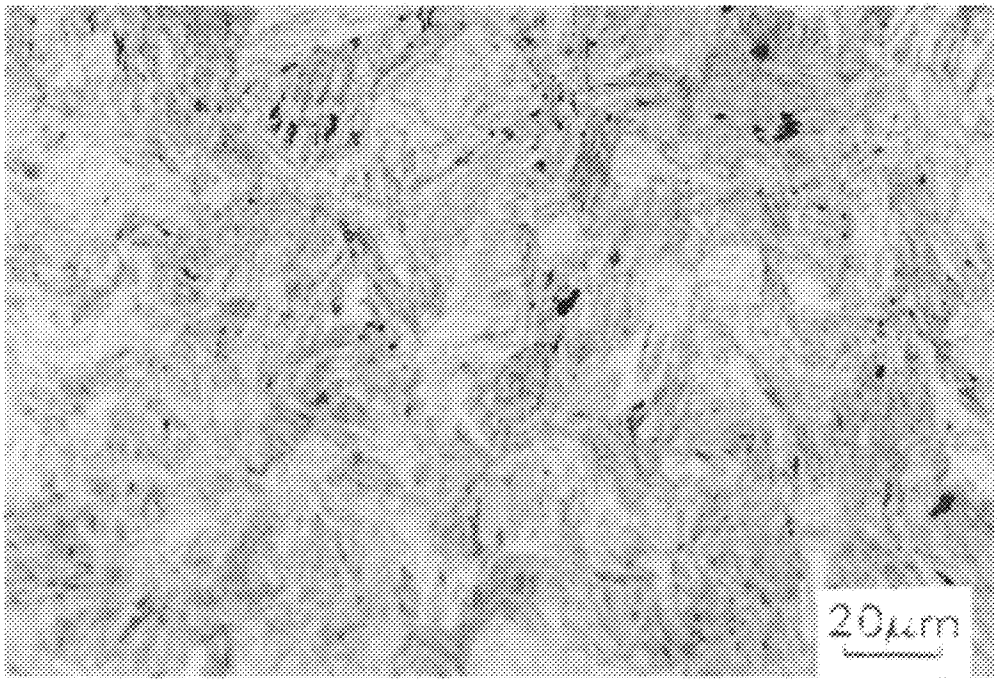
FIG. 3 is an optical micrograph of an as-quenched pipe formed according to the disclosed embodiments using a hold time of about 600 sec. The pipe is etched to illustrate the prior austenite grain boundaries.

FIG. 3 is an optical micrograph (2% nital etching) illustrating the microstructure of an as-quenched pipe formed according to the disclosed embodiments. The composition of the pipe was about 0.10% C, about 0.44% Mn, about 0.21% Si, about 2.0% Cr, about 0.93% Mo, about 0.14% about Ni, about 0.05% V, about 0.01% Al, about 0.006% N, about 0.0011% Ca, about 0.011% P, about 0.003% S, and about 0.14% Cu. The pipe possessed an outer diameter (OD) of about 273 mm and a wall thickness of about 13.9 mm. As illustrated in FIG. 3, the as-quenched pipe exhibited a microstructure that was mainly martensite and some lower bainite. Substantially no ferrite, upper bainite, or granular bainite was detected. The average prior austenite grain size (AGS) of the as-quenched pipe, measured according to ASTM E112 as lineal intercept, was approximately 20 μm, as austenitization was performed at about 980° C. for a short soaking time of about 600 sec.

Figure 4B:
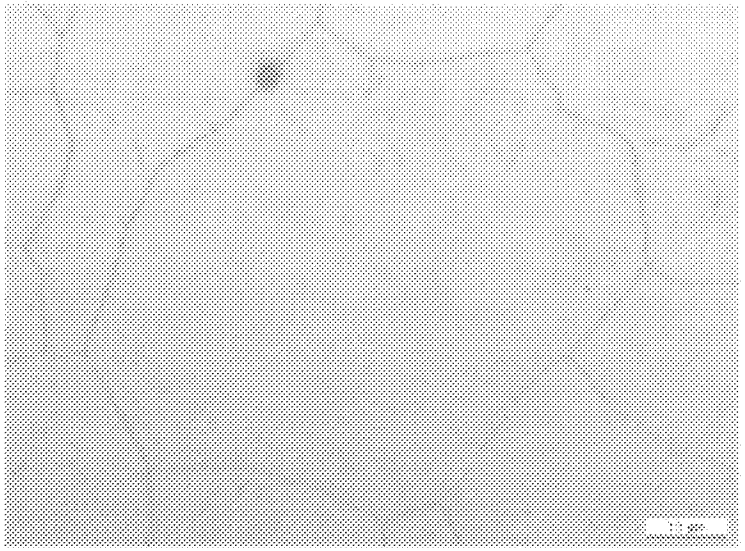
FIGS. 4A and 4B are optical micrographs of an as-quenched and tempered pipe formed according to the disclosed embodiments using a hold time of about 2400 sec. The pipe is etched to illustrate the prior austenite grain boundaries; (4A) 200× magnification; (4B) 1000× magnification.
Figure 4A:
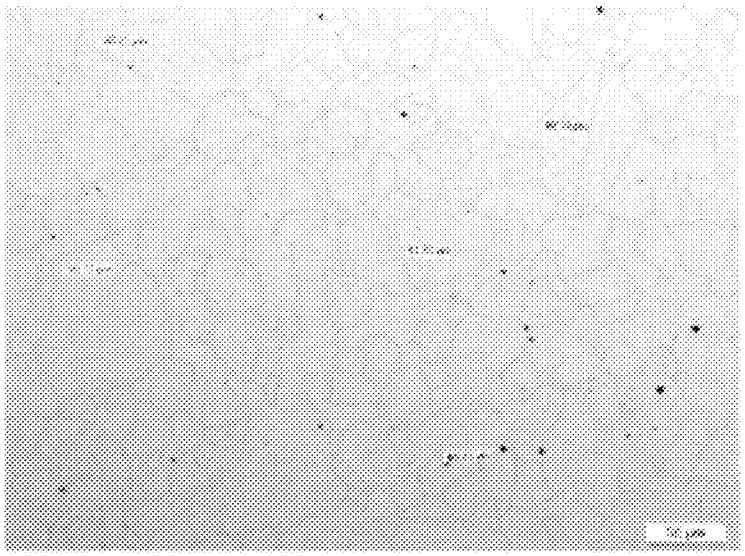

FIGS. 4A and 4B are optical micrographs illustrating the microstructure of the pipe after quenching and tempering according to the disclosed embodiments, where the soaking time is approximately 2400 sec. FIG. 4A shows an optical micrograph at low magnification, and FIG. 4B shows an optical micrograph at high magnification, illustrating the microstructure of an as-quenched pipe after selective etching to reveal the boundaries of the prior austenite grains. As illustrated in FIGS. 4A and 4B, the prior austenite grain size was large, approximately 47 μM and hardenability may be further improved with a volume percentage of martensite greater than about 90%. Notably, when the prior austenite grain size is less than or equal to about 20 μm and the volume percentage of martensite is greater than about 60%, after tempering, the average size of regions separated by high angle grain boundaries (i.e. packet size) may be approximately smaller than 6 μm.

Even when the prior austenite grain becomes larger, the packet size of the steel after quenching and tempering may be maintained below approximately 6 μm if a predominant martensite structure (e.g., martensite greater than about 60% in volume) is formed and lower bainite forms at relatively low temperatures (e.g., <540° C.).

Packet size may be measured as average lineal intercept on images taken by Scanning Electron Microscopy (SEM) using the Electron Back Scattered Diffraction (EBSD) signal, and considering high-angle boundaries those with misorientation greater than about 45°.

Figure 5:
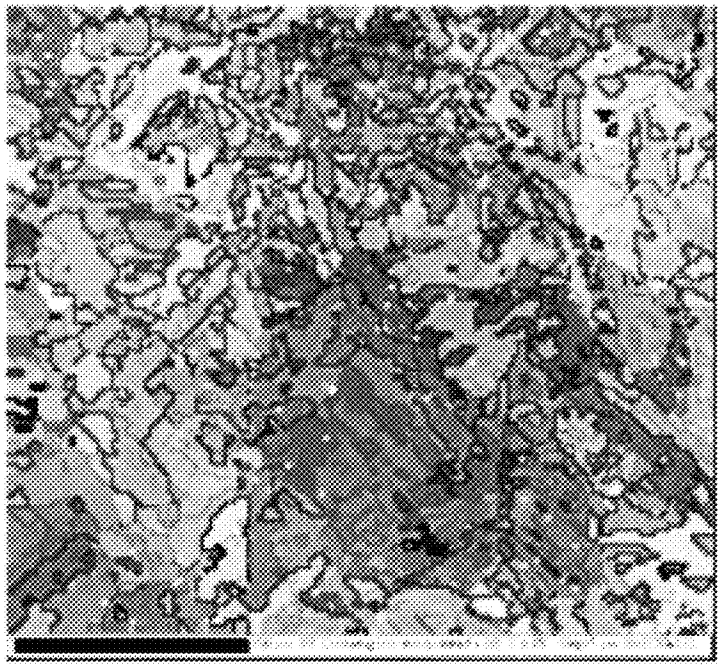
FIG. 5 is a micrograph taken by Scanning Electron Microscopy (SEM) using the Electron Back Scattered Diffraction (EBSD) signal, illustrating boundaries with low and high misorientation at about the mid-wall of the pipe of FIG. 4.

An example of inverse pole figure is shown in FIG. 5, where the boundary misorientation is indicated. Boundary misorientation less than about 3° are indicated as fine lines, while boundaries exhibiting a misorientation greater than about 45° are indicated as bold lines.

Figure 6:
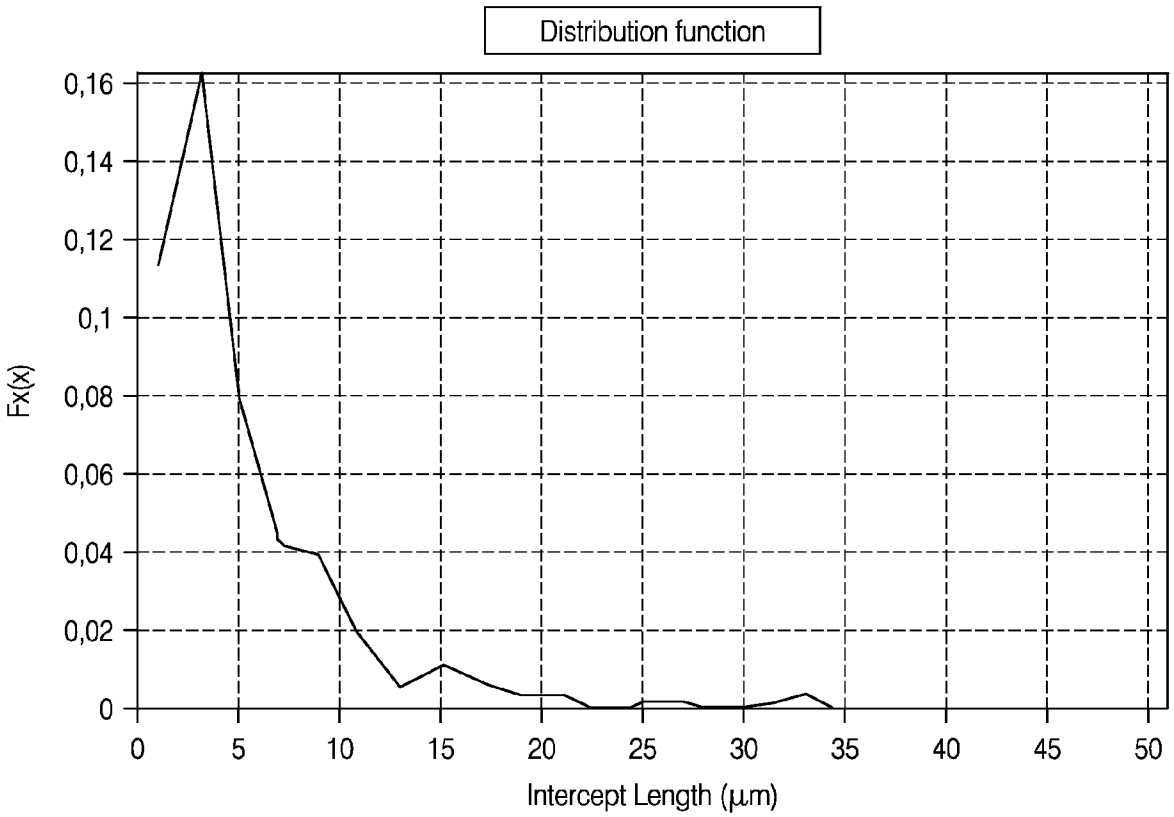
FIG. 6 is a plot illustrating the intercept distribution of boundaries with misorientation angle greater than about 45° for a steel formed according the disclosed embodiments.

Measurement by the lineal intercept method gave distribution shown in FIG. 6, with an average the packet size value of about 5 μm although the prior austenite grain size had an average value of about 47 μm as the amount of martensite in the microstructure was greater than about 95%.

On the quenched and tempered pipe, the fine precipitates of MX, $M_2X$, where M is Mo or Cr, or V, Nb, Ti when present, and X is C or N, with an average diameter less than about 40 nm were also detected by Transmission Electron Microscopy (TEM). Furthermore, the coarse precipitates of $M_3C$, $M_6C$, and/or $M_{23}C_6$ were also observed with an average diameter within the range between about 80 nm to about 400 nm.

The total volume percentage of non-metallic inclusions in the pipes so formed may be below about 0.05%, preferably below about 0.04%. The number of inclusions per square mm of examined area of oxides with size larger than about 15 μm are below about 0.4/mm$^2$. Substantially only modified round sulfides were observed.

EXAMPLES

In the following examples, the microstructural and mechanical properties and impact of steel pipes formed using embodiments of the steel making method discussed above are discussed. In particular, microstructural parameters including austenite grain size, packet size, martensite volume, lower bainite volume, volume of non-metallic inclusions, and inclusions of greater than about 15 μm are examined for embodiments of the compositions and heat treatment conditions discussed above. Corresponding mechanical properties, including yield and tensile strengths, hardness, elongation, toughness, and HIC/SSC resistance are further discussed.

Example 1

Mechanical and Microstructural Properties of Quenched and Tempered Pipes for 80 ksi Grade The microstructural and mechanical properties of the steel of Table 2 were investigated. With respect to the measurement of microstructural parameters, austenite grain size (AGS) was measured in accordance with ASTM E112, packet size was measured using an average lineal intercept on images taken by scanning electron microscopy (SEM) using the electron backscatter diffraction (EBSD) signal, the volume of martensite was measured in accordance with, the volume of lower bainite was measured in accordance with ASTM E562, the volume percentage of non-metallic inclusions was measured by automatic image analysis using optical microscopy in accordance with ASTM E1245, and the presence of precipitates was investigated by transmission electron microscopy (TEM) using the extraction replica method.

With respect to the mechanical properties, yield strength, tensile strength, and elongation were measured in accordance with ASTM E8, hardness was measured in accordance with ASTM E92, impact energy was evaluated on transverse Charpy V-notch specimens according to ISO 148-1, crack tip opening displacement was measured according to BS7488 part 1 at about −60° C., HIC evaluation was performed in accordance with NACE Standard TM0284-2003, Item No. 21215 using NACE solution A for a test duration of 96 hours. SSC evaluation was performed in accordance with NACE TM0177 using test solution A for a test duration of about 720 hours at about 90% specified minimum yield stress.

A heat of about 90 t, with the chemical composition range shown in Table 2, was manufactured by electric arc furnace.

TABLE 2

Chemical composition range of Example 1

| | C | Mn | Si | P | S | Ni | Cr | Mo | Ca | V | Nb | Ti | N | Cu | Al | As | Sb | Sn | B | H |
|---|---|---|---|---|---|---|---|---|---|---|---|---|---|---|---|---|---|---|---|---|
| Min | 0.10 | 0.40 | 0.20 | — | — | — | 1.9 | 0.9 | 0.001 | 0.05 | — | — | — | — | 0.010 | — | — | — | — | — |
| Max | 0.13 | 0.55 | 0.35 | 0.015 | 0.009 | 0.20 | 2.3 | 1.1 | 0.005 | 0.07 | 0.010 | 0.01 | 0.012 | 0.20 | 0.020 | 0.02 | 0.005 | 0.015 | 0.001 | 0.0003 |

After tapping, deoxidation, and alloying additions, secondary metallurgy operations were carried out in a ladle furnace and trimming station. After calcium treatment and vacuum degassing, the liquid steel was then continuously cast on a vertical casting machine as round bars of approximately 330 mm diameter.

The as-cast bars were re-heated by a rotary heath furnace to a temperature of about 1300° C., hot pierced, and the hollows were hot rolled by a retained mandrel multi-stand pipe mill and subjected to hot sizing in accordance process described above with respect to FIG. 1. The produced seamless pipes possessed an outside diameter of about 273.2 mm and a wall thickness of about 13.9 mm. The chemical composition measured on the resultant as-rolled seamless pipe is reported in Table 3.

TABLE 3

Chemical composition of seamless pipes of Example 1

| Pipe | C | Mn | Si | P | S | Ni | Cr | Mo | Ca | V | Nb | Ti |
|---|---|---|---|---|---|---|---|---|---|---|---|---|
| 1 | 0.10 | 0.44 | 0.21 | 0.011 | 0.003 | 0.14 | 2.0 | 0.93 | 0.010 | 0.05 | 0.004 | 0.001 |
| 2 | 0.10 | 0.44 | 0.21 | 0.011 | 0.003 | 0.14 | 2.0 | 0.93 | 0.012 | 0.05 | 0.004 | 0.001 |
| 3 | 0.10 | 0.43 | 0.20 | 0.011 | 0.003 | 0.14 | 2.0 | 0.89 | 0.011 | 0.05 | 0.004 | 0.001 |
| 4 | 0.10 | 0.44 | 0.21 | 0.010 | 0.003 | 0.14 | 2.0 | 0.93 | 0.010 | 0.06 | 0.004 | 0.001 |

| Pipe | N | Cu | Al | As | Sb | Sn | B | H |
|---|---|---|---|---|---|---|---|---|
| 1 | 0.006 | 0.14 | 0.01 | 0.01 | 0.001 | 0.010 | 0.0001 | 0.0002 |
| 2 | 0.006 | 0.14 | 0.01 | 0.01 | 0.001 | 0.010 | 0.0001 | 0.0002 |
| 3 | 0.006 | 0.15 | 0.01 | 0.01 | 0.001 | 0.010 | 0.0002 | 0.0002 |
| 4 | 0.007 | 0.14 | 0.01 | 0.01 | 0.001 | 0.009 | 0.0002 | 0.0002 |

The as-rolled pipes were subsequently austenitized by heating to a temperature of about 920° C. for approximately 2200 sec by a walking beam furnace, descaled by high pressure water nozzles, and externally and internally water quenched using a tank with stirred water and an inner water nozzle. The austenitizing heating rate was approximately 0.25° C./s. The cooling rate employed during quenching was approximately greater than 65° C./s. The quenched pipes were rapidly moved to another walking beam furnace for tempering treatment at a temperature of about 710° C. for a total time of about 5400 s and a soaking time of about 1800 sec. The tempering heating rate was approximately 0.2° C./s. The cooling employed after tempering was performed in still air at a rate approximately below 0.5° C./s. Each of the quenched and tempered (Q&T) pipes was hot straightened.

Parameters characterizing the microstructure and non-metallic inclusions of the pipes of Example 1 are shown in Table 4.

TABLE 4

Microstructural parameters of seamless pipes of Example 1

| Parameter | Average value |
|---|---|
| Austenite grain size (μm) | 47 |
| Packet size (μm) | 5.1 |
| Martensite (volume %) | 100 |
| Lower Bainite (volume %) | 0 |
| Volume of non-metallic inclusions (%) | 0.03 |
| Inclusions with size >15 μm (No./mm$^2$) | 0.2 |

The mechanical and corrosion properties of the pipes of Example 1 are shown in Tables 5, 6, and 7. Table 5 presents the tensile, elongation, hardness, and toughness properties of the quenched and tempered pipes. Table 6 presents the yield strength after two simulated post-weld heat treatments, PWHT1 and PWHT2. The post-weld heat treatment 1 (PWHT1) comprised heating and cooling at a rate of about 80° C./h to a temperature of about 650° C. with a soaking time of about 5 h. The post-weld heat treatment 2 (PWHT2) comprised heating and cooling at a rate of about 80° C./h to a temperature of about 650° C. with a soaking time of about 10 h. Table 7 presents the measured MC and SSC resistance of the quenched and tempered pipes.

TABLE 5

Mechanical properties of quenched and tempered pipes of Example 1

| Mechanical Property | Result |
|---|---|
| Average Yield Strength (MPa) | 615 |
| Minimum Yield Strength (MPa) | 586 |

TABLE 5-continued

Mechanical properties of quenched and tempered pipes of Example 1

| Mechanical Property | Result |
|---|---|
| Maximum Yield Strength (MPa) | 633 |
| Average Ultimate Tensile Strength, UTS (MPa) | 697 |
| Minimum Ultimate Tensile Strength, UTS (MPa) | 668 |
| Maximum Ultimate Tensile Strength, UTS (MPa) | 714 |
| Maximum YS/UTS ratio | 0.91 |
| Average Elongation (%) | 22.1 |
| Minimum Elongation (%) | 20.5 |
| Maximum Elongation (%) | 25.8 |
| Maximum Hardness ($HV_{10}$) | 232 |
| Average Impact Energy (J) at about −70° C. [transverse CVN specimens] | 250 |
| Individual Minimum Impact Energy (J) at about −70° C. [transverse CVN specimens] | 200 |
| 80% FATT (° C.) [transverse CVN specimens] | −90 |
| 50% FATT (° C.) [transverse CVN specimens] | −110 |
| Average CTOD (mm) at about −60° C. | 1.04 |

TABLE 6

Mechanical properties of quenched and tempered pipes of example 1 after simulated Post Weld Heat Treatment (PWHT1)

| | |
|---|---|
| Minimum Yield Strength (MPa) after PWHT1 | 565 |
| Minimum Yield Strength (MPa) after PWHT2 | 555 |

TABLE 7

HIC and SSC resistance of Q&T pipes of example 1

| | Result | Number of tests |
|---|---|---|
| HIC: | | |
| Crack Length Ratio, CLR % | 0 | 12 |
| Crack Thickness Ratio, CTR % | 0 | 12 |
| Crack Sensitivity Ratio, CSR % | 0 | 12 |
| SSC (NACE TM0177 method A, stress: 90% SMYS): | | |
| Failure time (h) | >720 (all passed) | 12 |

It was found from the testing results above (Table 5, Table 6, and Table 7) that the quenched and tempered pipes are suitable to develop a 555 MPa (80 ksi) grade, characterized by:

Yield strength (YS): about 555 MPa (80 ksi) minimum and about 705 MPa (102 ksi) maximum.

Ultimate Tensile Strength (UTS): about 625 MPa (90 ksi) minimum and about 825 MPa (120 ksi) maximum.

Hardness: below about 250 $HV_{10}$.

Elongation, not less than about 20%.

YS/UTS ratio less than or equal to about 0.93.

Minimum Impact Energy of about 250 J/about 200 J (average/individual) at about −70° C. on transverse Charpy V-notch specimens.

Excellent toughness in terms of 50% FATT (transition temperature for a fracture appearance with about 50% shear area) and 80% FATT (transition temperature for a fracture appearance with about 80% shear area), measured on transverse Charpy V-notch specimens tested according with standard ISO 148-1.

Excellent longitudinal Crack Tip Opening Displacement (CTOD) at about −60° C. (greater than about 0.8 mm).

Yield strength, YS of about 555 MPa minimum after simulated Post Weld Heat Treatments: heating and cooling rate of about 80° C./h, about 650° C. soaking temperature; soaking times: 5 h (PWHT1) and 10 h (PWHT2).

Good resistance to HIC (test according with NACE Standard TM0284-2003 Item No. 21215, using NACE solution A for a test duration about 96 hours) and SSC (test in accordance with NACE TM0177, using test solution A and about 1 bar $H_2S$, stressed at about 90% of specified minimum yield strength, SMYS).

Example 2

Mechanical and Microstructural Properties of Quenched and Tempered Pipes for 90 ksi Grade The microstructural and mechanical properties of the steel of Table 8 were investigated as discussed above with respect to Example 1. A heat of about 90 t, with the chemical composition shown in Table 8, was manufactured by electric arc furnace.

TABLE 8

Chemical composition of the heat of Example 2

| C | Mn | Si | P | S | Ni | Cr | Mo | Ca | V | Nb | Ti | N |
|---|---|---|---|---|---|---|---|---|---|---|---|---|
| 0.11 | 0.41 | 0.24 | 0.010 | 0.002 | 0.09 | 2.22 | 0.91 | 0.012 | 0.06 | 0.005 | 0.002 | 0.0074 |

| Cu | Al | As | Sb | Sn | B | H |
|---|---|---|---|---|---|---|
| 0.10 | 0.01 | 0.005 | 0.0018 | 0.009 | 0.0001 | 0.0002 |

After tapping, deoxidation, and alloying additions, secondary metallurgy operations were carried out in a ladle furnace and trimming station. After calcium treatment and vacuum degassing, the liquid steel was then continuously cast on a vertical casting machine as round bars of approximately 330 mm diameter.

The as-cast bars were re-heated by a rotary heath furnace to a temperature of about 1300° C., hot pierced, and the hollows were hot rolled by a retained mandrel multi-stand pipe mill and subjected to hot sizing in accordance process described above with respect to FIG. 1. The produced seamless pipes possessed an outside diameter of about 250.8 mm and a wall thickness of about 15.2 mm. The chemical composition measured on the resultant as-rolled seamless pipe is reported in Table 9.

TABLE 9

Chemical composition of seamless pipes of Example 2

| Pipe | C | Mn | Si | P | S | Ni | Cr | Mo | Ca | V | Nb | Ti |
|---|---|---|---|---|---|---|---|---|---|---|---|---|
| 1 | 0.10 | 0.44 | 0.21 | 0.011 | 0.003 | 0.14 | 2.0 | 0.93 | 0.010 | 0.05 | 0.004 | 0.001 |
| 2 | 0.10 | 0.44 | 0.21 | 0.011 | 0.003 | 0.14 | 2.0 | 0.93 | 0.012 | 0.05 | 0.004 | 0.001 |
| 3 | 0.10 | 0.43 | 0.20 | 0.011 | 0.003 | 0.14 | 2.0 | 0.89 | 0.011 | 0.05 | 0.004 | 0.001 |
| 4 | 0.10 | 0.44 | 0.21 | 0.010 | 0.003 | 0.14 | 2.0 | 0.93 | 0.010 | 0.06 | 0.004 | 0.001 |

| Pipe | N | Cu | Al | As | Sb | Sn | B | H |
|---|---|---|---|---|---|---|---|---|
| 1 | 0.006 | 0.14 | 0.01 | 0.01 | 0.001 | 0.010 | 0.0001 | 0.0002 |
| 2 | 0.006 | 0.14 | 0.01 | 0.01 | 0.001 | 0.010 | 0.0001 | 0.0002 |
| 3 | 0.006 | 0.15 | 0.01 | 0.01 | 0.001 | 0.010 | 0.0002 | 0.0002 |
| 4 | 0.007 | 0.14 | 0.01 | 0.01 | 0.001 | 0.009 | 0.0002 | 0.0002 |

The as-rolled pipes were subsequently austenitized by heating to a temperature of about 900° C. for approximately 2200 sec by a walking beam furnace, descaled by high pressure water nozzles, and externally and internally water quenched using a tank with stirred water and an inner water nozzle. The austenitizing heating rate was approximately 0.2° C./s. The cooling rate employed during quenching was approximately greater than about 60° C./s. The quenched pipes were rapidly moved to another walking beam furnace for tempering treatment at a temperature of about 680° C. for a total time of about 5400 s and a soaking time of about 1800 s. The tempering heating rate was approximately 0.2° C./s. The cooling employed after tempering was performed in still air at a rate approximately below 0.5° C./s. All the quenched and tempered (Q&T) pipes were hot straightened.

The main parameters characterizing the microstructure and non-metallic inclusions of the pipes of Example 2 are shown in Table 10.

TABLE 10

Microstructural parameters of seamless pipes of Example 2

| Parameter | Average value |
|---|---|
| Austenite grain size (μm) | 26.2 |
| Packet size (μm) | 3.8 |
| Martensite (volume %) | 95 |
| Lower Bainite (volume %) | 5 |
| Volume of non-metallic inclusions (%) | 0.028 |
| Inclusions with size >15 μm (No./mm$^2$) | 0.45 |

The mechanical properties of the pipes of Example 2 are shown in Table 11. Table 11 presents the tensile, elongation, hardness, and toughness properties of the quenched and tempered pipes.

TABLE 11

Mechanical properties of quenched and tempered pipes of Example 2

| Mechanical Property | Result |
|---|---|
| Average Yield Strength (MPa) | 690 |
| Minimum Yield Strength (MPa) | 681 |
| Maximum Yield Strength (MPa) | 706 |
| Average Ultimate Tensile Strength, UTS (MPa) | 743 |
| Minimum Ultimate Tensile Strength, UTS (MPa) | 731 |
| Maximum Ultimate Tensile Strength, UTS (MPa) | 765 |
| Maximum YS/UTS ratio | 0.93 |
| Average Elongation (%) | 20.1 |
| Minimum Elongation (%) | 18.5 |
| Maximum Elongation (%) | 23.4 |
| Maximum Hardness ($HV_{10}$) | 263 |
| Average Impact Energy (J) at about −70° C. [transverse CVN specimens] | 200 |
| Individual Minimum Impact Energy (J) at about −70° C. [transverse CVN specimens] | 150 |
| 80% FATT (° C.) [transverse CVN specimens] | −70 |
| 50% FATT (° C.) [transverse CVN specimens] | −80 |

It was found from the testing results above (Table 11) that the quenched and tempered pipes are suitable to develop a 90 ksi grade, characterized by:

- Yield strength, YS: about 625 MPa (90 ksi) minimum and about 775 MPa (112 ksi) maximum
- Ultimate Tensile Strength, UTS: about 695 MPa (100 ksi) minimum and about 915 MPa (133 ksi) maximum.
- Hardness: below about 270 $HV_{10}$.
- Elongation, not less than about 18%.
- YS/UTS ratio less than or equal to about 0.95.
- Minimum Impact Energy of about 150 J/about 100 J (average/individual) at about −70° C. on transverse Charpy V-notch specimens
- Excellent toughness in terms of 50% FATT (transition temperature for a fracture appearance with about 50% shear area) and 80% FATT (transition temperature for a fracture appearance with about 80% shear area), measured on transverse Charpy V-notch specimens tested according with standard ISO 148-1.

Good resistance to HIC (test according with NACE Standard TM0284-2003 Item No. 21215, using NACE solution A for test duration of about 96 hours), with:

Crack Length Ratio, CLR=0

Crack Thickness Ratio, CTR %=0

Crack Sensitivity Ratio, CSR %=0

Good SSC resistance was also observed in the samples. No failure was observed after about 720 h on the 3 tested specimens. Tests were conducted in accordance with NACE TM0177 method A, using test solution A, with a stress value greater than or equal to about 72% of specified minimum yield strength (SMYS) at about 1 bar $H_2S$ pressure.

Example 3

Comparative Example of Quenched and Tempered Pipe

In this comparative example, quenched and tempered pipes having an outer diameter of about 324.7 mm and wall thickness of about 15.7 mm, made of a typical line pipe steel with a low carbon equivalent of 0.4% (Table 12), were used to manufacture hot induction bends, off-line quench and temper, using embodiments of the process previously described.

TABLE 12

Composition of Comparative Example 3

| C | Mn | Si | P | S | Ni | Cr | Mo | Ca | V | Nb | Ti | N |
|---|---|---|---|---|---|---|---|---|---|---|---|---|
| 0.08 | 1.13 | 0.28 | 0.015 | 0.002 | 0.42 | 0.13 | 0.16 | 0.013 | 0.06 | 0.026 | 0.002 | 0.0055 |

| Cu | Al | As | Sb | Sn | B | H |
|---|---|---|---|---|---|---|
| 0.13 | 0.029 | 0.006 | 0.0027 | 0.01 | 0.0002 | 0.0002 |

The produced seamless pipes, were austenitized at about 920° C. for approximately 2200 sec, as discussed above, by a walking beam furnace. The pipes were further descaled by high pressure water nozzles and externally and internally water quenched using a tank with stirred water and an inner water nozzle. The quenched pipes were rapidly moved to another walking beam furnace for tempering treatment at about 660° C. to about 670° C. Each of the quenched and tempered pipes was hot straightened.

Parameters characterizing the microstructure and non-metallic inclusions of the Q&T bends are shown in Table 13.

TABLE 13

Microstructural Parameters of Comparative Example 3

| Parameter | Average value |
|---|---|
| Austenite grain size (μm) | 12.0 |
| Packet size (μm) | 7.1 |

TABLE 13-continued

| Microstructural Parameters of Comparative Example 3 | |
|---|---|
| Parameter | Average value |
| Lower Bainite (volume %) | 17 |
| Granular Bainite (volume %) | 75 |
| Ferrite (volume %) | 8 |
| Volume of non-metallic inclusions (%) | 0.04 |
| Inclusions with size >15 μm (No./mm$^2$) | 0.25 |

Figure 7:
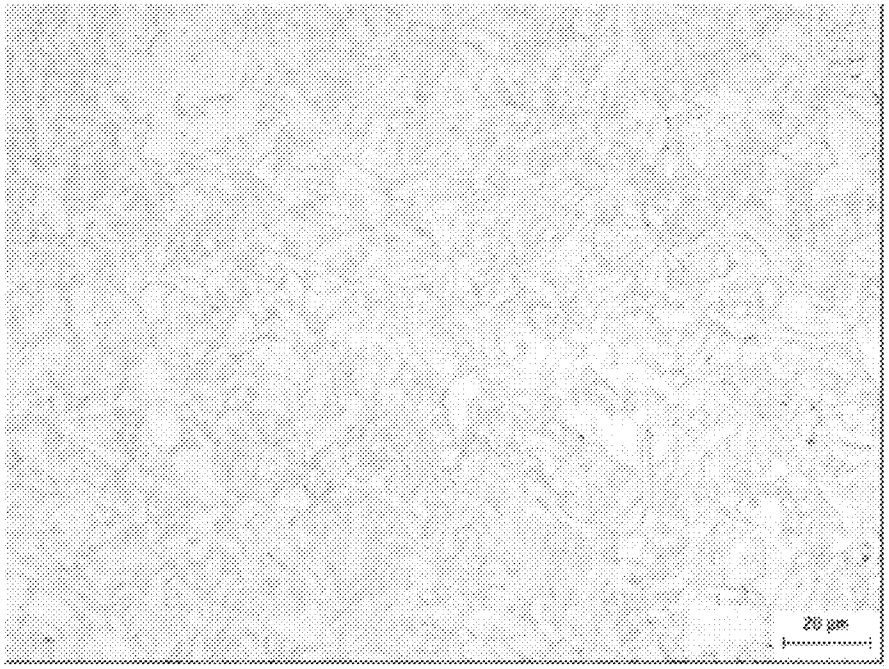
FIG. 7 is an optical micrograph at about the mid-wall of the as-quenched pipe of the comparative example of Example 3.

It was found that these quenched and tempered pipes, as they are manufactured with a steel that has a fine austenite grain (about 12 μm), do not develop enough hardenability to form martensite. Therefore, the microstructure exhibits a predominant granular bainite microstructure, including some lower bainite and also some amount of coarse ferrite (see FIG. 7 and Table 13). Moreover, the packet size is larger than that of the Examples 1 and 2.

It was further found (Table 14) that these quenched and tempered pipes are able to achieve the minimum yield strength of about 555 MPa (grade 80 ksi), but have a lower toughness with higher transition temperatures, as compared to Examples 1 and 2, due to their different microstructure.

TABLE 14

| Mechanical Properties of Quenched and Tempered Bends of Comparative Example 3 | |
|---|---|
| Mechanical Property | Result |
| Average Yield Strength (MPa) | 600 |
| Minimum Yield Strength (MPa) | 583 |
| Maximum Yield Strength (MPa) | 625 |
| Average Ultimate Tensile Strength, UTS (MPa) | 681 |
| Minimum Ultimate Tensile Strength, UTS (MPa) | 659 |
| Maximum Ultimate Tensile Strength, UTS (MPa) | 697 |
| Maximum YS/UTS ratio | 0.91 |
| Average Elongation (%) | 26.1 |
| Minimum Elongation (%) | 25.0 |
| Maximum Elongation (%) | 29.0 |
| Maximum Hardness ($HV_{10}$) | 239 |
| Average Impact Energy (J) at about −70° C. [transverse CVN specimens] | 193 |
| Individual Minimum Impact Energy (J) at about −70° C. [transverse CVN specimens] | 156 |
| 80% FATT (° C.) [transverse CVN specimens] | −40 |
| 50% FATT (° C.) [transverse CVN specimens] | −55 |

Example 4

Microstructural and Mechanical Properties of Bends in Quenched and Tempered Pipes The quenched and tempered pipes of Example 1 were used to manufacture bends having a radius of approximately 5 times the outer diameter of the pipe (5D).

The pipes were subjected to hot induction bending by heating to a temperature of approximately 850° C.+/−25° C. and subjected to in-line water quenching. The bends were then reheated to a temperature of about 920° C. and held at about this temperature for approximately 15 min in a car furnace. Subsequently, the bent pipes were moved to a water tank and immersed in stirred water. The minimum temperature of the bends was higher than about 860° C. just before immersion in the water tank and the temperature of the water of the tank was maintained below approximately 40° C.

Following the quenching operation, the as-quenched bends were tempered in a furnace set at a temperature within the range between about 700° C. to about 710° C. and held at this temperature for approximately 20 min.

TABLE 15

| Mechanical Properties of Quenched and Tempered Bends of Example 4 | |
|---|---|
| Mechanical Property | Result |
| Average Yield Strength (MPa) | 603 |
| Minimum Yield Strength (MPa) | 576 |
| Maximum Yield Strength (MPa) | 638 |
| Average Ultimate Tensile Strength, UTS (MPa) | 687 |
| Minimum Ultimate Tensile Strength, UTS (MPa) | 652 |
| Maximum Ultimate Tensile Strength, UTS (MPa) | 702 |
| Maximum YS/UTS ratio (—) | 0.91 |
| Average Elongation (%) | 22.0 |
| Minimum Elongation (%) | 20.5 |
| Maximum Elongation (%) | 25.0 |
| Maximum Hardness ($HV_{10}$) | 238 |
| Average Impact Energy (J) at about −70° C. [transverse CVN specimens] | 238 |
| Individual Minimum Impact Energy (J) at about −70° C. [transverse CVN specimens] | 202 |
| 80% FATT (° C.) [transverse CVN specimens] | −85 |
| 50% FATT (° C.) [transverse CVN specimens] | −100 |
| Average CTOD (mm) at about −45° C. | 0.94 |

TABLE 16

| HIC and SSC Resistance of Quenched and Tempered Bends of Example 2 | | |
|---|---|---|
| | Result | Number of tests |
| HIC: | | |
| Crack Length Ratio, CLR % | 0 | 3 |
| Crack Thickness Ratio, CTR % | 0 | 3 |
| Crack Sensitivity Ratio, CSR % | 0 | 3 |
| SSC (NACE TM0177 method A, stress: 90% SMYS): | | |
| Failure time (h) | >720 (all passed) | 3 |

It was found from the testing results above (Table 15, Table 16) that the offline quenched and tempered bends are suitable to develop a 555 MPa (80 ksi) grade, characterized by:

- Yield strength (YS): about 555 MPa (80 ksi) minimum and about 705 MPa (102 ksi) maximum
- Ultimate Tensile Strength (UTS): about 625 MPa (90 ksi) minimum and about 825 MPa (120 ksi) maximum.
- Maximum hardness: below about 25 $HV_{10}$.
- Elongation, not less than about 18%.
- YS/UTS ratio no higher than about 0.93.
- Minimum Impact Energy of about 250 J/about 200 J (average/individual) at about −70° C. on transverse Charpy V-notch specimens.
- Excellent toughness in terms of 50% FATT (transition temperature for a fracture appearance with about 50% shear area) and 80% FATT (transition temperature for a fracture appearance with about 80% shear area), measured on transverse Charpy V-notch specimens.
- Excellent longitudinal Crack Tip Opening Displacement (CTOD) at about −45° C. greater than about 0.8 mm).
- Good resistance to HIC (test according with NACE Standard TM0284-2003 Item No. 21215, using NACE solution A for a test duration of about 96 hours) and SSC (test in accordance with NACE TM0177, using test solution A and about 1 bar $H_2S$, stressed at about 90% of specified minimum yield strength, SMYS).

Example 5

Mechanical Properties of Quenched and Tempered Pipes for 70 ksi Grade

The mechanical properties of the steel of Table 17 were investigated as discussed above with respect to Example 1. A heat of about 90 t, with the chemical composition range shown in Table 17, was manufactured by electric arc furnace.

TABLE 17

Chemical composition range of the heat of Example 5

| | C | Mn | Si | P | S | Ni | Cr | Mo | Ca | V | Nb | Ti | N | Cu | Al | As | Sb | Sn | B | H |
|---|---|---|---|---|---|---|---|---|---|---|---|---|---|---|---|---|---|---|---|---|
| Min | 0.10 | 0.40 | 0.20 | — | — | — | 2.0 | 0.9 | 0.001 | — | — | — | — | — | — | — | — | — | — | — |
| Max | 0.13 | 0.55 | 0.35 | 0.015 | 0.009 | 0.20 | 2.5 | 1.1 | 0.005 | 0.02 | 0.010 | 0.01 | 0.012 | 0.20 | 0.020 | 0.02 | 0.005 | 0.025 | 0.001 | 0.0003 |

After tapping, deoxidation, and alloying additions, secondary metallurgy operations were carried out in a ladle furnace and trimming station. After calcium treatment and vacuum degassing, the liquid steel was continuously cast on a vertical casting machine in round bars of approximately 330 mm in diameter.

The as-cast bars were re-heated by a rotary heath furnace to a temperature of about 1300° C., hot pierced, and the hollows were hot rolled by a retained mandrel multi-stand pipe mill and subjected to hot sizing in accordance process described above with respect to FIG. 1. The produced seamless pipes possessed an outside diameter of about 273.1 mm and a wall thickness of about 33 mm. The chemical composition measured on the resultant as-rolled seamless pipe is reported in Table 18.

TABLE 18

Chemical composition of seamless pipes of Example 5

| Pipe | C | Mn | Si | P | S | Ni | Cr | Mo | Ca | V | Nb | Ti |
|---|---|---|---|---|---|---|---|---|---|---|---|---|
| 1 | 0.13 | 0.48 | 0.26 | 0.011 | 0.001 | 0.12 | 2.07 | 0.95 | 0.013 | <0.01 | <0.01 | 0.001 |
| 2 | 0.14 | 0.46 | 0.24 | 0.011 | 0.001 | 0.11 | 2.14 | 0.95 | 0.010 | <0.01 | <0.01 | 0.001 |

| Pipe | N | Cu | Al | As | Sb | Sn | B | H |
|---|---|---|---|---|---|---|---|---|
| 1 | 0.0074 | 0.13 | 0.014 | 0.006 | 0.0013 | 0.007 | 0.0001 | 0.0002 |
| 2 | 0.0083 | 0.13 | 0.014 | 0.006 | 0.0007 | 0.008 | 0.0001 | 0.0002 |

The as-rolled pipes were subsequently austenitized by heating to a temperature of about 920° C. for approximately 5400 sec by a walking beam furnace, descaled by high pressure water nozzles, and externally and internally water quenched using a tank with stirred water and an inner water nozzle. The austenitizing heating rate was approximately 0.16° C./s. The cooling rate employed during quenching was approximately 25° C./s. The quenched pipes were rapidly moved to another walking beam furnace for tempering treatment at a temperature of about 750° C. for a total time of about 8600 sec and a soaking time of about 4200 sec. The tempering heating rate was approximately 0.15° C./s. The cooling rate employed during tempering was approximately less than about 0.1° C./s. Each of the quenched and tempered (Q&T) pipes was hot straightened.

The mechanical properties and corrosion resistance of the pipes of Example 5 are shown in Table 19 and Table 20, respectively. Table 20 presents the tensile, elongation, hardness, and toughness properties of the quenched and tempered pipes.

TABLE 19

Mechanical properties of quenched and tempered pipes of Example 5

| Mechanical Property | Result |
|---|---|
| Average Yield Strength (MPa) | 514 |
| Minimum Yield Strength (MPa) | 494 |
| Maximum Yield Strength (MPa) | 545 |
| Average Ultimate Tensile Strength, UTS (MPa) | 658 |
| Minimum Ultimate Tensile Strength, UTS (MPa) | 646 |
| Maximum Ultimate Tensile Strength, UTS (MPa) | 687 |
| Maximum YS/UTS ratio (—) | 0.83 |
| Average Elongation (%) | 22.2 |
| Minimum Elongation (%) | 20.6 |
| Maximum Elongation (%) | 24.2 |
| Maximum Hardness ($HV_{10}$) | 218 |

TABLE 19-continued

Mechanical properties of quenched and tempered pipes of Example 5

| Mechanical Property | Result |
|---|---|
| Average Impact Energy (J) at about −70° C. [transverse CVN specimens] | 270 |
| Individual Minimum Impact Energy (J) at about −70° C. [transverse CVN specimens] | 200 |
| 80% FATT (° C.) [transverse CVN specimens] | <−90 |
| 50% FATT (° C.) [transverse CVN specimens] | <−110 |

TABLE 20

HIC and SSC resistance of Q&T pipes of Example 5

| | Result | Number of tests |
|---|---|---|
| HIC: | | |
| Crack Length Ratio, CLR % | 0 | 12 |
| Crack Thickness Ratio, CTR % | 0 | 12 |
| Crack Sensitivity Ratio, CSR % | 0 | 12 |
| SSC (NACE TM0177 method A, stress: 90% SMYS): | | |
| Failure time (h) | >720 (all passed) | 12 |

It was found from the testing results above (Table 20 and Table 21) that the quenched and tempered pipes are suitable to develop a 485 MPa (70 ksi grade), characterized by:

Yield strength (YS): about 70 ksi (485 MPa) minimum and about 92 ksi (635 MPa) maximum Ultimate Tensile Strength (UTS): about 83 ksi (570 MPa) minimum and about 110 ksi (760 MPa) maximum.

Maximum hardness: less than about 248 $HV_{10}$.

Elongation, not less than about 18%.

YS/UTS ratio no higher than about 0.93.

Minimum Impact Energy greater than about 200 J/about 150 J (average/individual) at about −70° C. on transverse Charpy V-notch specimens.

Excellent toughness in terms of 50% FATT (transition temperature for a fracture appearance with about 50% shear area) and 80% FATT (transition temperature for a fracture appearance with about 80% shear area), measured on transverse Charpy V-notch specimens.

Good resistance to HIC (test according with NACE Standard TM0284-2003 Item No. 21215, using NACE solution A and test duration of about 96 hours) and SSC (test in accordance with NACE TM0177, using test solution A and about 1 bar $H_2S$, stressed at about 90% of specified minimum yield strength, SMYS).

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion, but should be defined by the appended claims.

What is claimed is:

1. A seamless steel pipe, comprising:

a steel composition comprising:

Fe;

about 0.05 wt. % to about 0.16 wt. % carbon;

about 0.20 wt. % to about 0.90 wt. % manganese;

about 0.10 wt. % to about 0.50 wt. % silicon;

about 1.20 wt. % to about 2.60 wt. % chromium;

about 0.05 wt. % to about 0.50 wt. % nickel;

about 0.80 wt. % to about 1.20 wt. % molybdenum;

about 0.005 wt. % to about 0.12 wt. % vanadium about 0.008 wt. % to about 0.04 wt. % aluminum;

about 0.0030 wt. % to about 0.0120 wt. % nitrogen; and about 0.0010 wt. % to about 0.005 wt. % calcium;

wherein the wall thickness of the steel pipe is greater than or equal to 8 mm and less than or equal to 35 mm;

wherein the steel pipe is processed to have a yield strength greater than 550 MPa (80 ksi) and wherein the microstructure of the steel pipe comprises martensite in a volume percentage greater than or equal to 60% and lower bainite in a volume percentage less than or equal to 40%;

wherein the microstructure of the steel pipe does not include upper bainite nor ferrite;

wherein the steel pipe has a ductile to brittle transition temperature less than −70° C.; and wherein the steel pipe does not exhibit failure due at least in part to stress corrosion cracking after about 720 hours when subjected to a stress of about 90% of the yield stress and tested according to National Association of Corrosion Engineers standard TM0177.

2. The steel pipe of claim 1, wherein the steel composition further comprises:

about 0 to about 0.80 wt. % tungsten;

about 0 to about 0.030 wt. % niobium;

about 0 to about 0.020 wt. % titanium;

about 0 to about 0.30 wt. % copper;

about 0 to about 0.010 wt. % sulfur;

about 0 to about 0.020 wt. % phosphorus;

about 0 to about 0.0020 wt. % boron;

about 0 to about 0.020 wt. % arsenic;

about 0 to about 0.0050 wt. % antimony;

about 0 to about 0.020 wt. % tin;

about 0 to about 0.030 wt. % zirconium;

about 0 to about 0.030 wt. % tantalum;

about 0 to about 0.0050 wt. % bismuth;

about 0 to about 0.0030 wt. % oxygen; and about 0 to about 0.00030 wt. % hydrogen;

wherein the remainder of the composition comprises iron and impurities.

3. The steel pipe of claim 2, wherein the steel composition comprises:

about 0.07 wt. % to about 0.14 wt. % carbon;

about 0.30 wt. % to about 0.60 wt. % manganese;

about 0.10 wt. % to about 0.40 wt. % silicon;

about 1.80 wt. % to about 2.50 wt. % chromium;

about 0.05 wt. % to about 0.20 wt. % nickel;

about 0.90 wt. % to about 1.10 wt. % molybdenum;

about 0 to about 0.60 wt. % tungsten;

about 0 to about 0.015 wt. % niobium;

about 0 to about 0.010 wt. % titanium;

about 0.050 wt. % to 0.10 wt. % vanadium about 0.010 wt. % to about 0.030 wt. % aluminum;

about 0.0030 wt. % to about 0.0100 wt. % nitrogen;

about 0 to about 0.20 wt. % copper;

about 0 to about 0.005 wt. % sulfur;

about 0 to about 0.012 wt. % phosphorus;

about 0.0010 wt. % to about 0.003 wt. % calcium;

about 0.0005 wt. % to about 0.0012 wt. % boron;

about 0 to about 0.015 wt. % arsenic;

about 0 to about 0.0050 wt. % antimony;

about 0 to about 0.015 wt. % tin;

about 0 to about 0.015 wt. % zirconium;

about 0 to 0.015 wt. % tantalum about 0 to about 0.0050 wt. % bismuth;

about 0 to about 0.0020 wt. % oxygen; and about 0 to about 0.00025 wt. % hydrogen;

wherein the remainder of the composition comprises iron and impurities.

4. The steel pipe of claim 2, wherein the steel composition comprises:

about 0.08 wt. % to about 0.12 wt. % carbon;

about 0.30 wt. % to about 0.50 wt. % manganese;

about 0.10 wt. % to about 0.25 wt. % silicon;
2.10 wt. % to about 2.40 wt. % chromium;
about 0.05 wt. % to about 0.20 wt. % nickel;
about 0.95 wt. % to about 1.10 wt. % molybdenum;
about 0 to about 0.30 wt. % tungsten;
about 0 to about 0.010 wt. % niobium;
about 0 to about 0.010 wt. % titanium;
about 0.050 wt. % to about 0.07 wt. % vanadium
about 0.015 wt. % to about 0.025 wt. % aluminum;
about 0.0030 wt. % to about 0.008 wt. % nitrogen;
about 0 to about 0.15 wt. % copper;
about 0 to about 0.003 wt. % sulfur;
about 0 to about 0.010 wt. % phosphorus;
about 0.0015 wt. % to about 0.003 wt. % calcium;
about 0.0008 wt. % to about 0.0014 wt. % boron;
about 0 to about 0.015 wt. % arsenic;
about 0 to about 0.0050 wt. % antimony;
about 0 to about 0.015 wt. % tin;
about 0 to about 0.010 wt. % zirconium;
about 0 to about 0.010 wt. % tantalum;
about 0 to about 0.0050 wt. % bismuth;
about 0 to about 0.0015 wt. % oxygen;
about 0 to about 0.00020 wt. % hydrogen; and
wherein the remainder of the composition comprises iron and impurities.

5. The steel pipe of claim 1, wherein the yield strength is greater than 625 MPa (90 ksi).

6. The steel pipe of claim 1, wherein the microstructure of the steel pipe consists of martensite and lower bainite.

7. The steel pipe of claim 1, wherein the microstructure of the steel pipe does not include granular bainite.

8. The steel pipe of claim 1, wherein the volume percentage of martensite is greater than or equal to 95% and the volume percentage of lower bainite is less than or equal to 5%.

9. The steel pipe of claim 8, wherein the volume percentage of martensite is 100%.

10. The steel pipe of claim 1, wherein the steel pipe has a packet size less than or equal to 6 μm.

11. The steel pipe of claim 1, further comprising one or more particulates having the composition MX or $M_2X$ having an average diameter less than or equal to 40 μm, wherein M is selected from V, Mo, Nb, and Cr and X is selected from C and N.

12. The steel pipe of claim 1, wherein steel pipe has a Charpy V-notch energy greater or equal to 250 J/cm$^2$.

13. A 550 MPa (80 ksi) grade seamless steel pipe, comprising:

Fe;
about 0.10 wt. % to about 0.13 wt. % carbon;
about 0.40 wt. % to about 0.55 wt. % manganese;
about 0.20 wt. % to about 0.35 wt. % silicon;
2.1 wt. % to about 2.6 wt. % chromium;
about 0.9 wt. % to about 1.10 wt. % molybdenum;
about 0.001 wt. % to about 0.005 wt. % calcium;
about 0.050 wt. % to about 0.07 wt. % vanadium;
about 0.010 wt. % to about 0.020 wt. % aluminum;
wherein a wall thickness of the steel pipe is greater than or equal to 8 mm and less than or equal to 35 mm; and
wherein the steel pipe is processed by:
hot rolling followed by cooling to room temperature,
heating to a temperature of about 900° C. or above,
quenching at a cooling rate greater than or equal to 40° C./sec, and
tempering at a temperature between 680° C. to 760° C.,
wherein the processed steel pipe has a microstructure comprising a prior austenite grain size of about 20 μm to about 80 μm, a packet size of about 3 μm to about 6 μm, about 90% martensite by volume or greater, and about 10% lower bainite by volume or less, wherein the microstructure does not include ferrite; and
wherein the steel pipe has a yield strength (YS) between about 550 MPa (80 ksi) and about 705 MPa (102 ksi), an ultimate tensile strength (UTS) between about 625 MPa (90 ksi) and about 825 MPa (120 ksi), elongation no less than about 20%, and a YS/UTS ratio no higher than about 0.93.

* * * * *